US007591732B2

(12) United States Patent
Speigl

(10) Patent No.: US 7,591,732 B2
(45) Date of Patent: Sep. 22, 2009

(54) HYDRAULIC DRIVE PIN SETTER FOR BOWLING ALLEY WITH HYDRAULIC LINKAGE BALL LIFT

(75) Inventor: Philip Bernard Speigl, Grand Rapids, MI (US)

(73) Assignee: Speigl Bowling Systems, Inc., Reno, NV (US)

( * ) Notice: Subject to any disclaimer, the term of this patent is extended or adjusted under 35 U.S.C. 154(b) by 0 days.

(21) Appl. No.: 10/549,125

(22) PCT Filed: Jun. 17, 2004

(86) PCT No.: PCT/US2004/016622

§ 371 (c)(1),
(2), (4) Date: Sep. 16, 2005

(87) PCT Pub. No.: WO2005/000434

PCT Pub. Date: Jan. 6, 2005

(65) Prior Publication Data

US 2006/0211508 A1 Sep. 21, 2006

Related U.S. Application Data

(60) Provisional application No. 60/479,491, filed on Jun. 17, 2003.

(51) Int. Cl.
*A63D 5/08* (2006.01)

(52) U.S. Cl. ..... 473/73; 473/89; 473/95; 473/97; 473/111

(58) Field of Classification Search ..... 473/73, 473/86, 87, 89, 90, 91, 94, 95, 96, 97, 98, 473/99, 100, 106, 110, 111, 54, 55, 109, 473/125

See application file for complete search history.

(56) References Cited

U.S. PATENT DOCUMENTS 1,627,414 A 5/1927 Schaffer
2,616,694 A * 11/1952 Montooth ..... 473/86
2,621,961 A * 12/1952 Whipple ..... 294/115
2,634,978 A * 4/1953 Anderson ..... 473/84

(Continued)

OTHER PUBLICATIONS

Brunswick Service Parts Catalog; Muskegon, Michigan, p. 44, Nov. 1961.*

(Continued)

*Primary Examiner*—William M Pierce
(74) *Attorney, Agent, or Firm*—Sughrue Mion, PLLC

(57) ABSTRACT

An electromechanical pin setter including a hydraulic drive component. The present invention includes a deck assembly holds pins in deck chutes and reciprocates vertically to spot and re-spot pins on a pin setting location on a bowling lane, a rake mechanism removes pins from the bowling lane, a pit conveyor moves pins and a bowling ball toward a pin elevator, the pin elevator in a pit area lifts pins to a cross conveyor, the cross conveyor delivers pins to a turret, the turret distributes pins to the deck chutes, and a ball elevator to lift the bowling ball to a ball return track. A hydraulic drive component having at least one of a fluid motor and a fluid drive cylinder controls an operation of at least one of the deck assembly, the rake mechanism, the pit conveyor, the pin elevator, the cross conveyor, the turret, and the ball elevator.

19 Claims, 19 Drawing Sheets

U.S. PATENT DOCUMENTS

| | | | | | |
|---|---|---|---|---|---|
| 2,645,485 | A | * | 7/1953 | Mead | 473/83 |
| 2,656,187 | A | | 10/1953 | Blair | |
| 2,676,016 | A | | 4/1954 | Whipple | |
| 2,697,605 | A | | 12/1954 | Montooth | |
| 2,817,529 | A | * | 12/1957 | Montooth | 473/86 |
| 2,841,397 | A | | 7/1958 | Montooth | |
| 2,853,300 | A | * | 9/1958 | Montooth et al. | 473/96 |
| 3,235,257 | A | | 2/1966 | Rogers | |
| 3,778,057 | A | | 12/1973 | Leidl | |
| 4,133,042 | A | | 1/1979 | Wallace | |
| 5,292,121 | A | | 3/1994 | Heddon | |
| 5,429,554 | A | | 7/1995 | Burkholder | |
| 5,449,327 | A | | 9/1995 | Heddon | |
| 5,616,084 | A | | 4/1997 | Heddon et al. | |
| 5,653,641 | A | | 8/1997 | Heddon | |
| 5,759,108 | A | | 6/1998 | Heddon | |
| 5,803,819 | A | | 9/1998 | Tuten et al. | |
| 6,402,629 | B1 | | 6/2002 | Heddon | |

OTHER PUBLICATIONS http://www.tpub.com/content/engine/14105/css/14105_13.htm, Introduction to Fluid Power, website, Nov. 2003.*

Communication from European Patent Office/Supplementary European Search Report, Application No. 04753451.6—2318, dated Aug. 6, 2007.

Brunswick Corporation, Automatic Pinsetter Service Manual, Bowling Service Department, Muskegon, Michigan, pp. iii-v, 1-1 to 5-12 (without Section 1 p. 1-39 thru p. 1-40, Section III, p. 3-1 to p. 3-8, and Section IV, p. 5-13 thru p. 5-23), Jan. 1988.

Brunswick Corporation, Automatic Pinsetter Service Parts Catalog, Feb. 1983, (without pp. 13-14).

* cited by examiner

HYDRAULIC DRIVE PIN SETTER FOR BOWLING ALLEY WITH HYDRAULIC LINKAGE BALL LIFT

CROSS-REFERENCE TO RELATED APPLICATIONS

This application claims the benefit of U.S. Provisional Application No. 60/479,491, filed on Jun. 17, 2003, in the United States Patent and Trademark Office, the disclosure of which is incorporated herein by reference in its entirety.

BACKGROUND OF THE INVENTION

1. Field of Invention

Apparatuses and methods consistent with the present invention relate to bowling pin setting machines. Specifically, the apparatuses and methods relate to hydraulically actuated bowling pin setting machine controlled by a programmable logic controller.

2. Description of the Related Art

Automatic pin setters for bowling alleys have been in existence for more than fifty years. Originally, automatic pin setters were electromechanical devices, wherein a series of interrelated belts, pulleys, and cams were driven by one or more electric motors. There are problems with existing electromechanical pin setters in that they require a high degree of maintenance and a highly skilled maintenance technician. Parts and labor and service are expensive and sometimes unavailable or stressful financially for some bowling alley operators. On the other hand, complete replacement of all of the pin setters in a bowling alley with more current pin setters is often cost prohibitive.

SUMMARY OF THE INVENTION

An aspect of the present invention is to provide an improved pin setting drive mechanism. An another aspect of the present invention can be retrofitted in an existing electromechanical pin setter, such as a pin setter manufactured by BRUNSWICK that is currently in widespread use. Another aspect of the present invention is to provide improvements in certain features of an automatic pin setter.

An embodiment of the present invention includes an electromechanical pin setter wherein a deck assembly holds pins in deck chutes and reciprocates vertically to spot and re-spot pins on a pin setting location on a bowling lane, a rake mechanism removes pins from the bowling lane, a pit conveyor moves pins and a bowling ball toward a pin elevator, the pin elevator in a pit area lifts pins to a cross conveyor, the cross conveyor delivers pins to a turret, the turret distributes pins to the deck chutes, a ball elevator to lift the bowling ball to a ball return track, the electromechanical pin setter including a hydraulic drive component having at least one of a fluid motor and a fluid drive cylinder, hydraulic drive component operated by a source of pressurized fluid through an electrically controlled valve, to control an operation of at least one of the deck assembly, the rake mechanism, the pit conveyor, the pin elevator, the cross conveyor, the turret, and the ball elevator; and a controller individually controlling and sequencing operations of the electrically controlled valve to control operations of the hydraulic drive component.

Another embodiment of the present invention is a method for operating an electromechanical pin setter wherein a deck assembly holds pins in deck chutes and reciprocates vertically to spot and re-spot pins on a pin setting location on a bowling lane, a rake mechanism removes pins from the bowling lane, a pit conveyor moves pins and a bowling ball toward a pin elevator, the pin elevator in a pit area lifts pins to a cross conveyor, the cross conveyor delivers pins to a turret, the turret distributes pins to the deck chutes, a ball elevator to lift the bowling ball to a ball return track, the method including controlling an operation of at least one of the deck assembly, the rake mechanism, the pit conveyor, the pin elevator, the cross conveyor, the turret, and the ball elevator by a hydraulic drive component including at least one of a fluid motor and a fluid drive cylinder, said at least one of fluid motor and fluid drive cylinder operated by a source of pressurized fluid through an electrically controlled valve; and individually controlling and sequencing operations of the electrically controlled valve to control operations of the hydraulic drive component through a programmable controller.

DETAILED DESCRIPTION OF EXEMPLARY EMBODIMENTS

One aspect of the present invention is an improved drive mechanism for a pin setter of the type that is conventionally driven by an elaborate electromechanical system of belts, pulleys, and cams driven by an electric motor. Existing systems are well-known in the art and will not be described in detail herein. An existing electromechanical pin setter manufactured by BRUNSWICK is shown in FIGS. 1-7.

Figure 1:
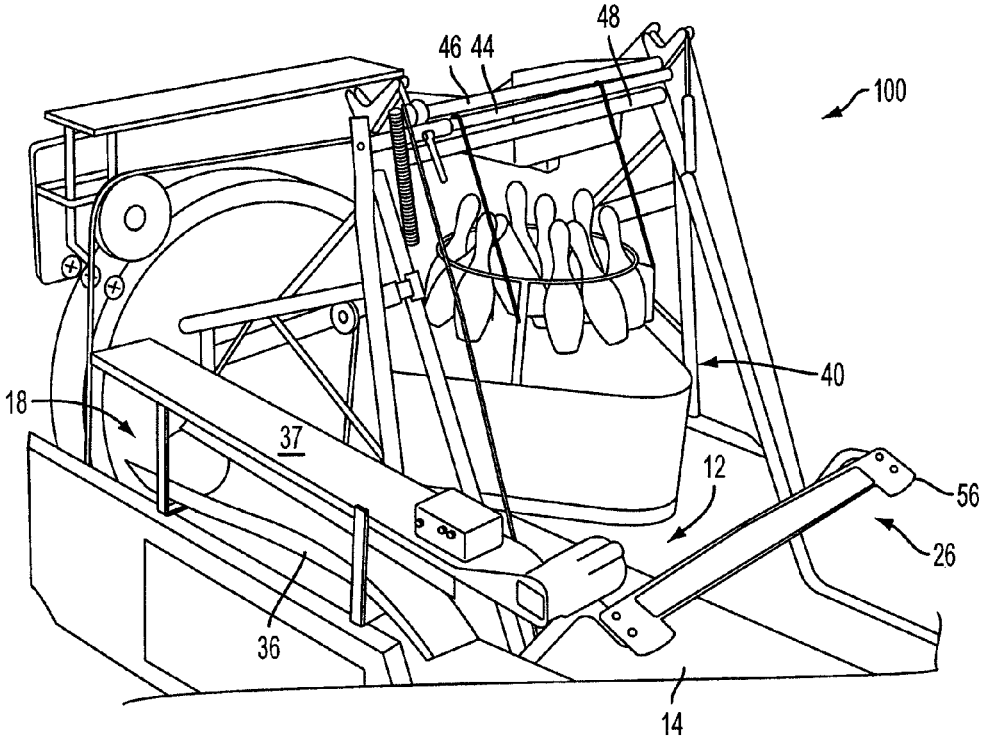
FIG. 1 (PRIOR ART)
FIG. 1 is a perspective view of a conventional pinsetter.
Figure 2:
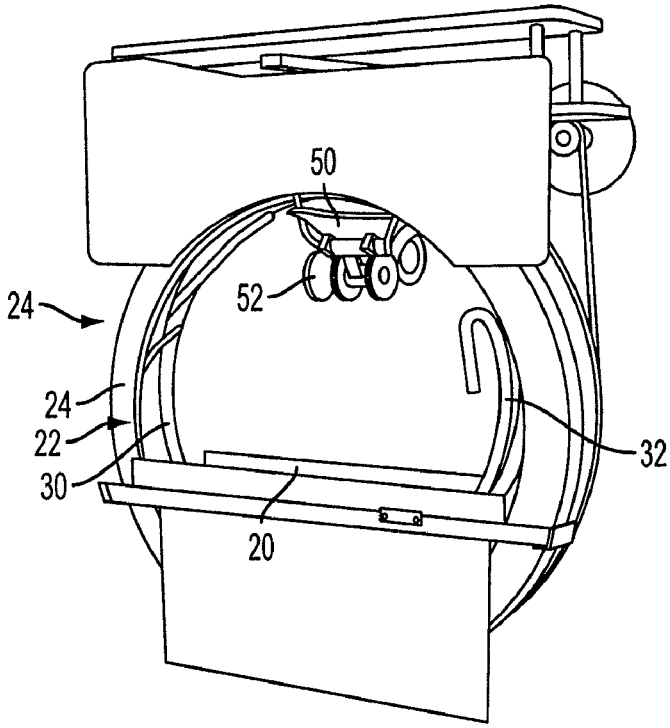
FIG. 2 (PRIOR ART)
FIG. 2 is a rear view of the conventional pinsetter.

FIGS. 1 and 2 show a conventional automatic pin setter 10 mounted over a pin setter location 12 at the end of a bowling lane 14. The pin setter location 12 is flanked by raised sidewalls called kickbacks 16. Behind the pin setter location 12 is an area called the pit 18 which includes a downwardly and rearwardly inclined pit conveyor 20, which leads to a circular ball elevator 22 and a pin elevator 24. The pit conveyor 20 is an oscillating or vibrating device which causes the pins to gravitate downwardly to the bottom of the ball and pin elevators 22, 24. A padded movable cushion called a pit cushion 26 (FIG. 7) is positioned behind the pin setter location 12 over the pit conveyor 20 and positioned to receive and cushion the impact of a bowling ball after it has traveled through the pin setter location 12. The pit cushion 26 is pivotally mounted and can be raised to permit the ball and pins to proceed rearwardly to the ball and pin elevators 22, 24 after the main force of the ball momentum has been cushioned by the pit cushion 26. Hereinafter, rearwardly or the rear of the pin setter 10 refer to an end of the pin setter 10 where the ball and pin elevators 22, 24 are disposed and forwardly or the front of the pin setter refers to an end of the pin setter 10 where the rake 56 is disposed.

Figure 3:
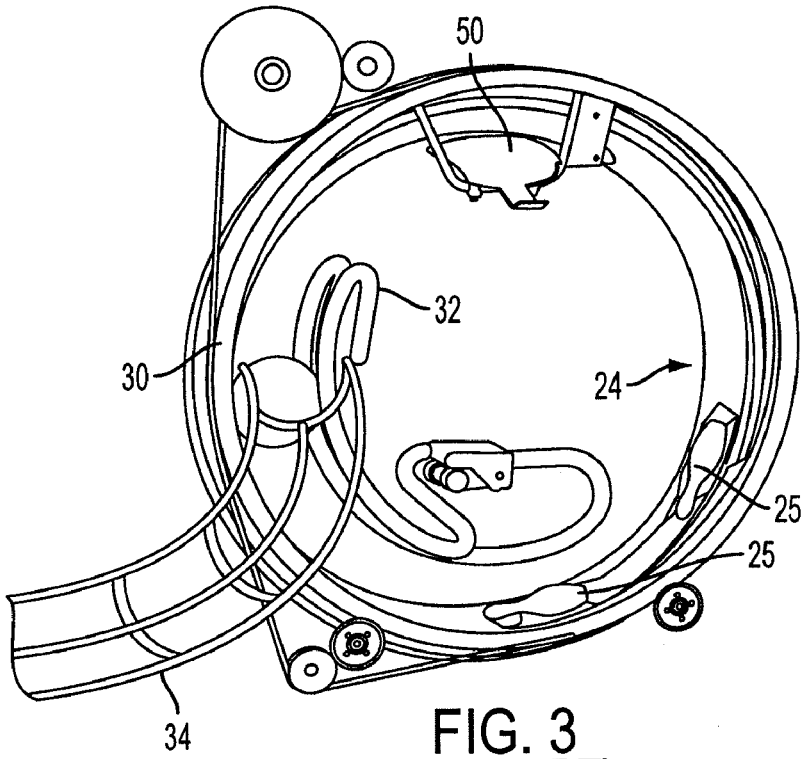
FIG. 3 (PRIOR ART)
FIG. 3 is a view of a ball elevator.
Figure 4:
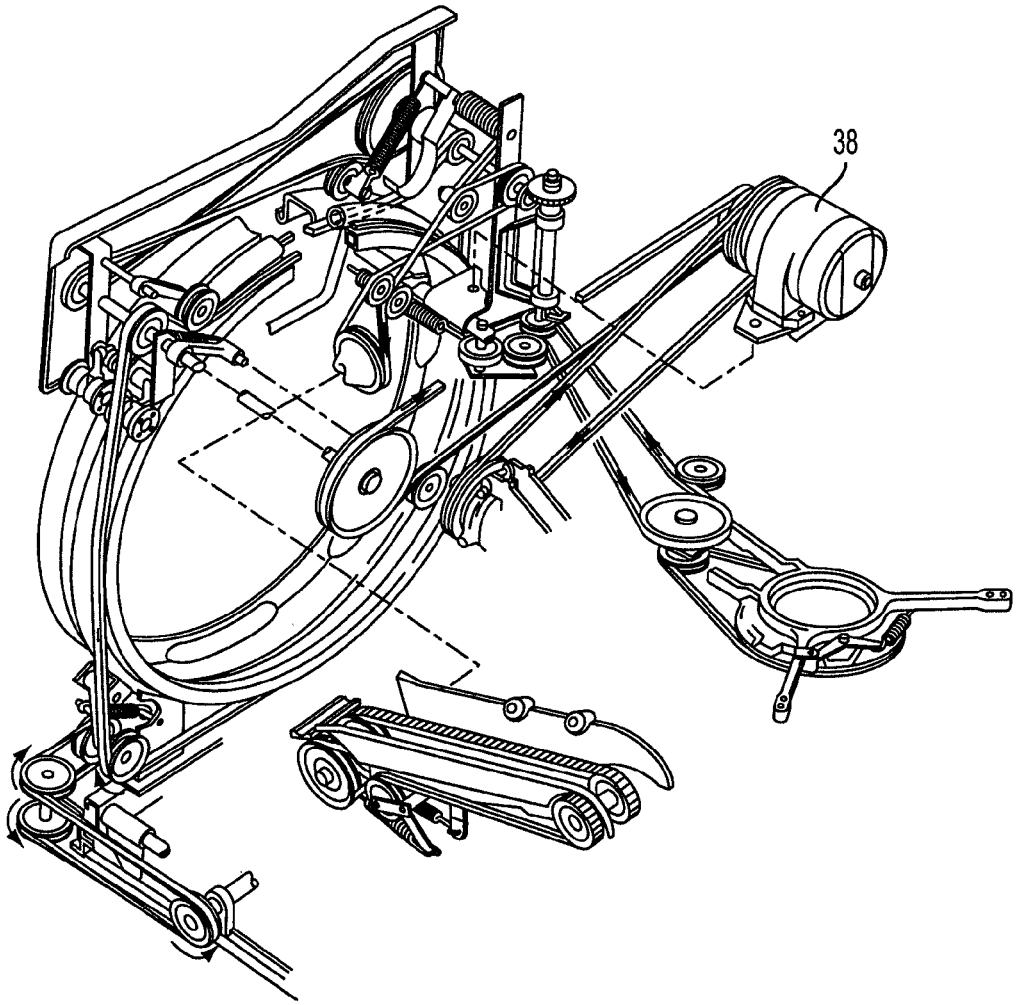
FIG. 4 (PRIOR ART)
FIG. 4 is a perspective view of a conventional gear box.

FIG. 3 shows the ball and pin elevators 22, 24 including a rotating pin elevator wheel 28 and a counter-rotating ball elevator wheel 30. Pins drop into notches 25 in the pin elevator wheel 28 and are held in place by the notches 25. Balls contact ball lift rods 32 and are pressed thereby against the ball elevator wheel 30 so that they roll up the ball elevator wheel 30 to an elevated position where the ball is diverted from the ball elevator wheel 30 and falls onto a track 34 that leads downwardly to a ball return track 36 (FIG. 1), which carries the ball to the opposite end of the bowling lane 14, where the bowler can retrieve the ball. An accelerator 37 (FIG. 1), comprising an elongated driven belt, engages the top of the ball and urges it toward the head of the bowling lane 14. As shown in FIG. 4, the conventional automatic pin setter 10 has an electric motor 38 to drive a mechanical system of pulleys and belts and cams through a gear box in order to coordinate a number of mechanically timed operations of the automatic pin setter 10. The parts of the mechanical system wear out and require periodic replacement and continuous adjustment. Moreover, these mechanical systems are quite complex and require a highly skilled technician to maintain, lubricate, adjust, and repair these systems.

Figure 5:
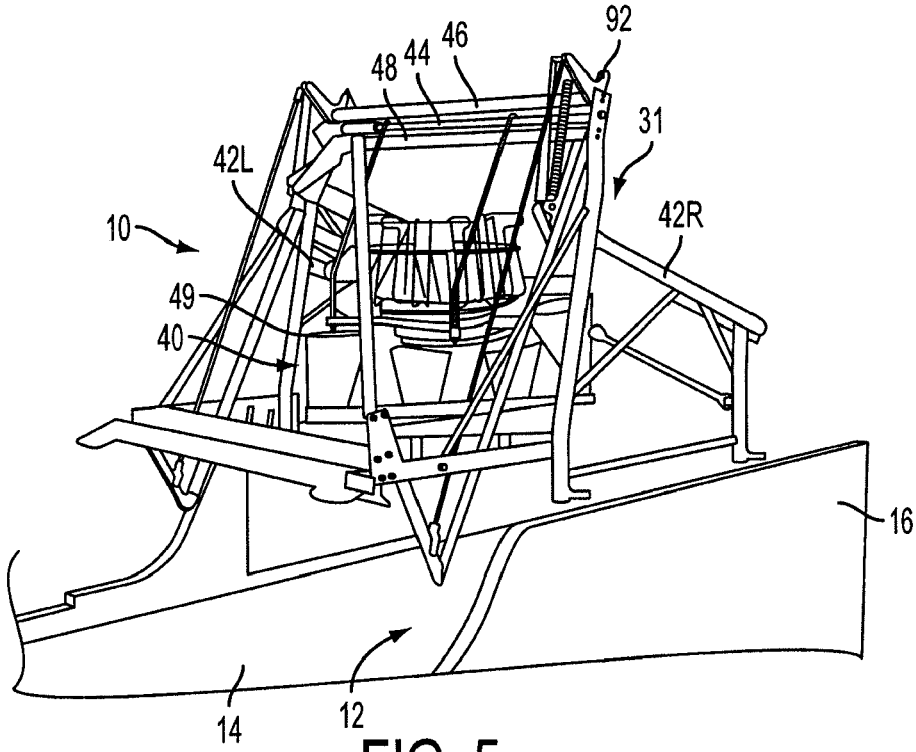
FIG. 5 (PRIOR ART)
FIG. 5 is a view of the conventional pin setter.

Another element of the automatic pin setter 10 is a pin setter deck assembly 40 shown in FIG. 5, mounted over the pin setter location 12 on the end of the bowling lane 14. The deck assembly 40 is supported on a frame 31, which includes left and right side frames 42L and 42R and a plurality of cross shafts. The cross shafts include a main cross shaft 44, a rake lift shaft 46, and a rake sweep shaft 48. Deck assembly 40 includes a raisable, triangular mechanism that includes properly positioned receptacles for ten pins. The deck assembly 40 retains the pins in the pin receptacles called deck chutes 49 and then releases the pins onto the surface of the bowling lane 14 when the deck assembly 40 is lowered. The pin setter deck assembly 40 also is capable of picking up and resetting standing pins that remain after a first ball is bowled.

Figure 6:
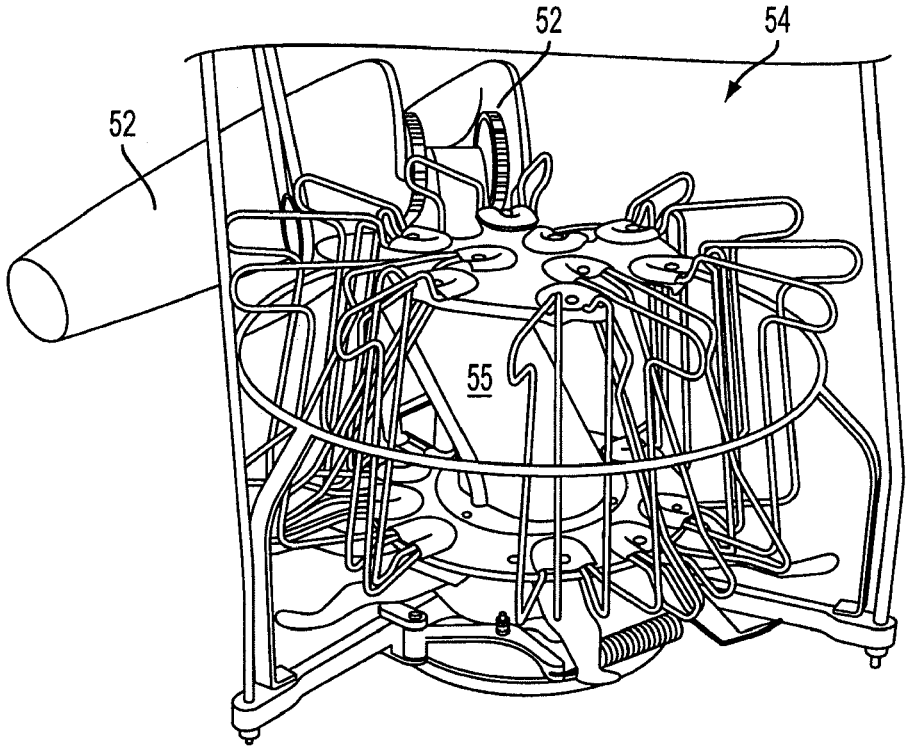
FIG. 6 (PRIOR ART)
FIG. 6 is a view of a cross conveyor and a turret.

Pins are transported from the pin elevator 24 to the deck assembly 40 as follows. When the pins reach the top of the pin elevator wheel 28, the pins are discharged into a contoured pan, called a turn around pan 50 (FIG. 3). This turn around pan 50 causes the pins to become oriented with their bases facing forwardly toward the bowler, regardless of which way the pins were oriented when they reached the top of the pin elevator wheel 28. Pins are thereafter conveyed upwardly over the deck assembly 40 by means of a cross conveyor 52, as shown in FIG. 6. When they reach the end of the cross conveyor 52, the pins are deposited in separate receptacles in a wire basket called a turret 54. Turret 54 is rotatably mounted above the pin setter deck assembly 40 and rotates in an indexed movement one location at a time to receive each pin as it reaches the turret 54 until the turret 54 is full, at which time additional pins are prevented from being deposited on the turret 54. When the pin setter deck assembly 40 returns to its raised position after the end of a bowler's turn, a triggering mechanism causes the turret 54 to release ten new pins into the chutes 49 in the deck assembly 40 and the deck assembly 40 then lowers and deposits the pins on the bowling lane 14.

Figure 7:
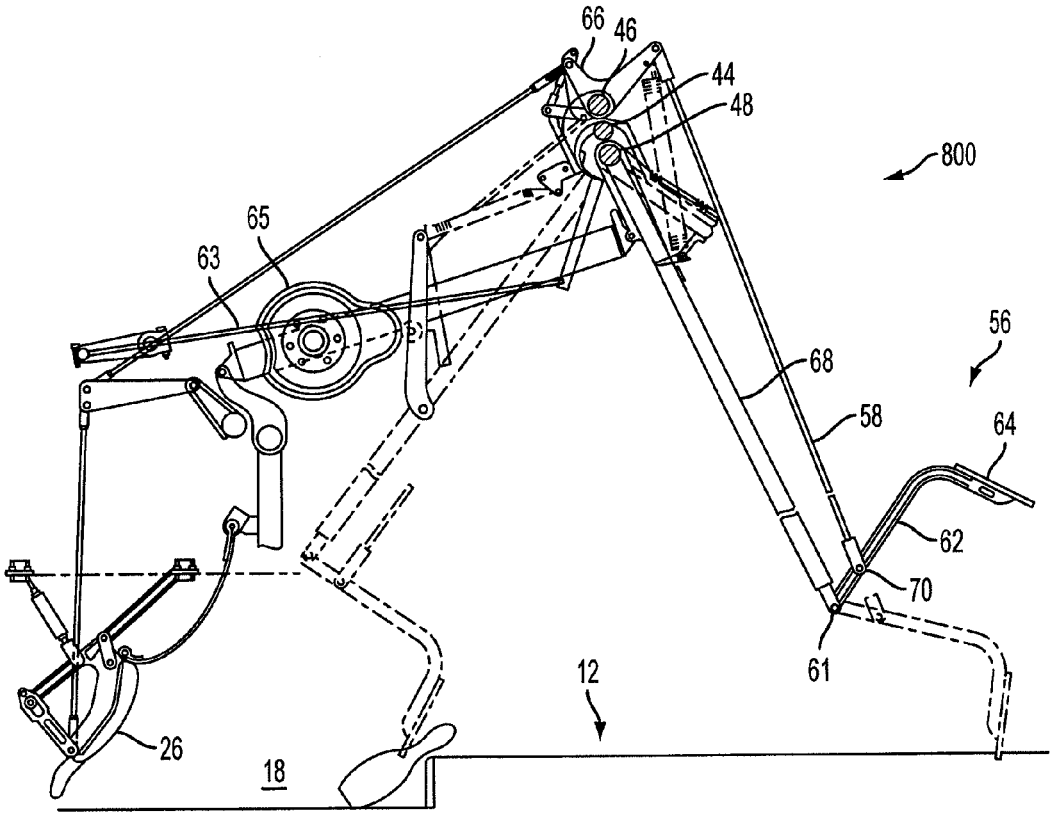
FIG. 7 (PRIOR ART)
FIG. 7 is a view of a rake sweep mechanism.

In order to remove fallen pins at the end of a first ball or all pins after a second ball has been rolled, a rake sweep mechanism 700 is shown in FIG. 7. The rake sweep mechanism 700 includes a rake 56 that lowers to a position in front of the pin setter location 12 and then moves rearwardly to remove the fallen pins ("dead wood") from the bowling lane 14. The rake 56 includes a pair of spaced rake support arms 58 mounted at an upper end on the rake sweep shaft 48. A lower end is connected to a rake sweep arm 62 that extends outwardly and downwardly and is pivotally mounted around the distal end 61 of the rake support arm 58. A fiberglass rake board 64 extends across the bowling lane 14 between outer ends of the rake sweep arms 62. The rake 56 is lowered by means of the pin setter electromechanical drive mechanism, which rotates a V lever 66 on the rake lift shaft 48. A rake lift rod 68 on the end of the V lever 66 extends to a position 70 between the rake board 64 and the distal end 61 of the rake support arm 58 on the rake sweep arm 62. Rotation of the rake sweep shaft 48 thus causes the rake sweep arm 62 to pivot on the end of the rake support arm 58 so as to raise and lower the rake board 64 toward and away from the bowling lane 14.

The rake 56 is mechanically connected to the other elements in the system and triggered so that the rake 56 automatically lowers and sweeps dead wood from the bowling lane 14 after the end of each bowling turn. A rake lift cam 63 operated by the main gearbox maintains the rake 56 in a level position while it is retracted by the arcuate movement of the rake support arms 58. The rake sweep mechanism is mechanically linked to the pit cushion 26 to cause the pit cushion 26 to be raised when the rake 56 is actuated.

All of the foregoing elements are present in the automatic pin setter 10 shown in FIGS. 1-7. All of the elements of the automatic pin setter 10 are essentially linked mechanically for sequential operation. Actuation is accomplished by mechanical actuators, such as the contact between a bowling ball and the pit cushion 26. The contact signifies that a turn is over and initiates a series of mechanically dependent steps that cause the pin setter deck assembly 40 to lower to pick up standing pins and cause the rake 56 to actuate to remove dead wood. The conventional system also includes mechanical sensors that determine whether or not there are standing pins and whether the pins are out of position or not.

In accordance with the present invention, many of the electromechanical components of the foregoing system have been removed or deactuated, replacing many interdependent moving parts with a series of very simple, cost-effective fluid cylinders such as hydraulic cylinders that are actuated at appropriate times by a programmable logic controller ("PLC") that operates relays for electrical solenoid control valves that in turn actuate the hydraulic cylinders. The present system replaces many mechanical drive components with a few simple, non-temperamental hydraulic drives and a single controller that can be programmed and reprogrammed to vary the timing and sequence of the individual elements as may be desired. This is all accomplished without requiring complete replacement of the principal components of the electromechanical system, mainly the pin setter deck assembly 40, turret 54, cross conveyor 52, pin and ball elevators 28, 30, and sweep mechanism 700. However, as an additional aspect of the present invention, some of the conventional features have been modified or improved, such as the ball elevator 22 and the sweep mechanism 700, as will be described more fully below. The elements employed in the present invention that are similar to the elements employed in the conventional automatic pin setter 10 described above are identified with the same numerals as the present invention.

Figure 8:
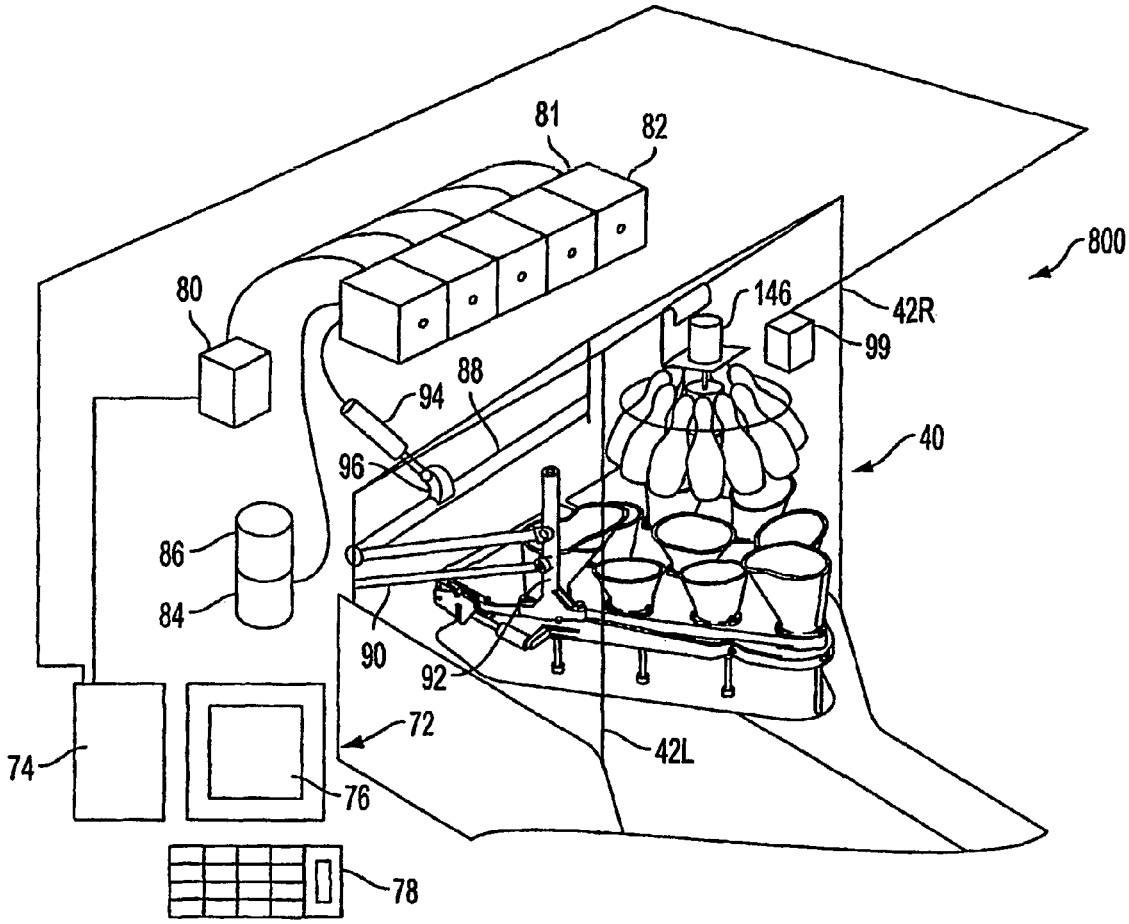
FIG. 8 is a perspective view of an embodiment of the present invention.

FIG. 8 shows an automatic pin setter 800 of the present invention. In the pin setter 800, a programmable logic controller (PLC) 80 generates output signals to a series of output terminals 81 that control the operation of the hydraulic components of the present invention. The PLC 80 operates relays (internal, as shown, or external) that control the solenoid operated hydraulic control valves 82 that control the hydraulic drives to be described below. These hydraulic control valves 82 open or close conduits providing pressurized hydraulic fluid to the various operating components of the drive mechanism. Hydraulic fluid for the entire system is provided by a hydraulic pump 84 driven by an electric motor 86. A computer 72 comprising a CPU 74, monitor 76, and keyboard 78 can be connected to the PLC 80 in order to set up, adjust, or change the programming in the PLC 80.

One aspect of the invention with respect to the existing pin setter is that the electromechanical drive components controlling the deck assembly 40 are replaced by a series of hydraulic drives. The deck assembly 40 continues to be supported and lifted by a deck lift shaft 88 pivotally mounted between the two side frames 42L, 42R. Deck lift arms 90 extend from the deck lift shaft 88, and the deck lift arms 90 are connected to deck support arms 92 that are attached to the deck assembly 40 itself. Rotation of the deck lift shaft 88 thus raises and lowers the deck assembly 40. A deck hydraulic lift cylinder 94 including a linearly extending output shaft which moves in a linear motion, rotates the deck lift shaft 88 through a drive arm 96 extending outwardly from the deck support shaft 88. Hydraulics to the deck hydraulic lift cylinder 94 are controlled through a PLC controlled valve 82.

Figure 9:
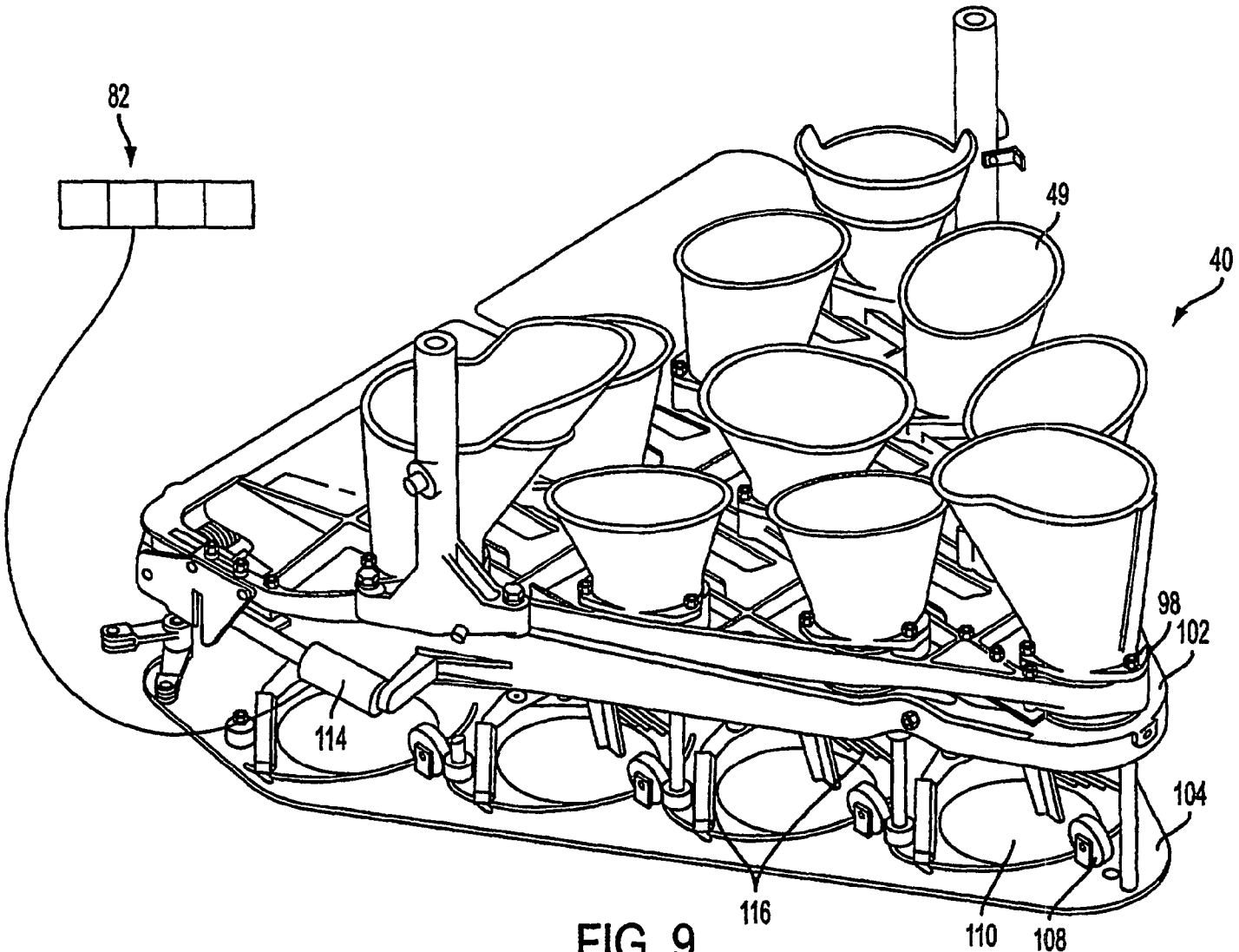
FIG. 9 is a perspective view of a deck assembly.
Figure 10:
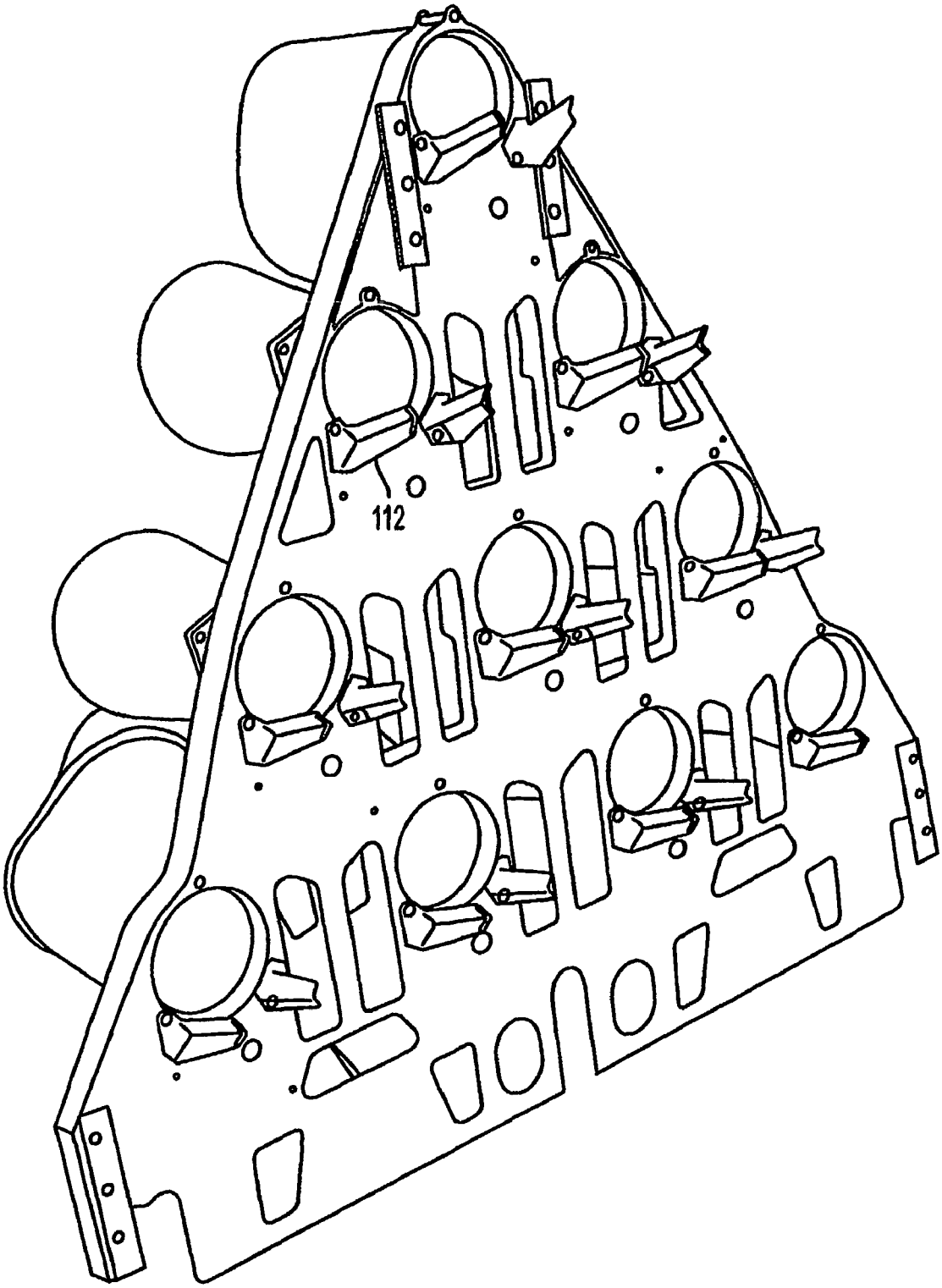
FIG. 10 is a view of the deck assembly.

The pin setter deck assembly 40 includes an upper portion called an upper deck or movable deck 98 (FIG. 9). The movable deck 98 is superimposed over a lower deck called a stationary deck 100. Deck chutes 103 are mounted on the movable deck 98 and hold ten individual pins. The stationary deck 100 has two layers, an upper cast metal plate 102, and a thinner lower plate 104, sometimes called a scissor plate. The two plates are spaced apart by connecting rods or bolts. The lower plate 104 has pin supporting rollers 108 at front edges of pin openings 110. The movable deck 98, which contains deck chutes 103 has openings which are aligned with the rollers 108 when the movable deck 98 is in a forward position. FIG. 10 shows the underside of the movable deck 98 having fingers 112 on a rear side of the chute openings in the movable deck 98. The fingers 112 urge the pins to a forward position. The movable deck 98 reciprocates to the rear to release the pins from the movable deck 98. It first moves to an intermediate position where the pins are pulled to the side of the rollers 108. The fingers 22 hold the pins against the sides of the rollers 108 and prevent the pins from dropping out of the movable deck 98 completely. When the movable deck 98 becomes positioned adjacent to the bowling lane 14, the movable deck 98 is moved further rearwardly toward the pit 18, releasing the pins completely and letting the pins move downwardly to the surface of the bowling lane 14.

Whereas an electromechanical drive was used to accomplish this movement in the past, in the present invention, the movable deck 98 of the present invention is moved by a linear motion of an extendable output shaft of the hydraulic movable deck drive cylinder 114, which is again controlled independently by the PLC 80 through one of the electric valves 82.

The movable deck 98 also includes pairs of clamping arms called scissors 116. The scissors 116 are positioned adjacent to the pin openings 110 in the lower plate 104 and are pivotal over the lower plate 104 to clamp the neck of a pin in place in the plate 104 when the movable deck 98 moves downwardly after a first ball is thrown.

In the conventional pin setter, a standing pin engages a rubber pad on the movable deck 98 which stops the downward movement of the movable deck 98. This actuates a series of mechanical devices that clamp the standing pins in the movable deck 98 and lift the standing pins upwardly while the rake 56 removes the dead wood.

Figure 11A:
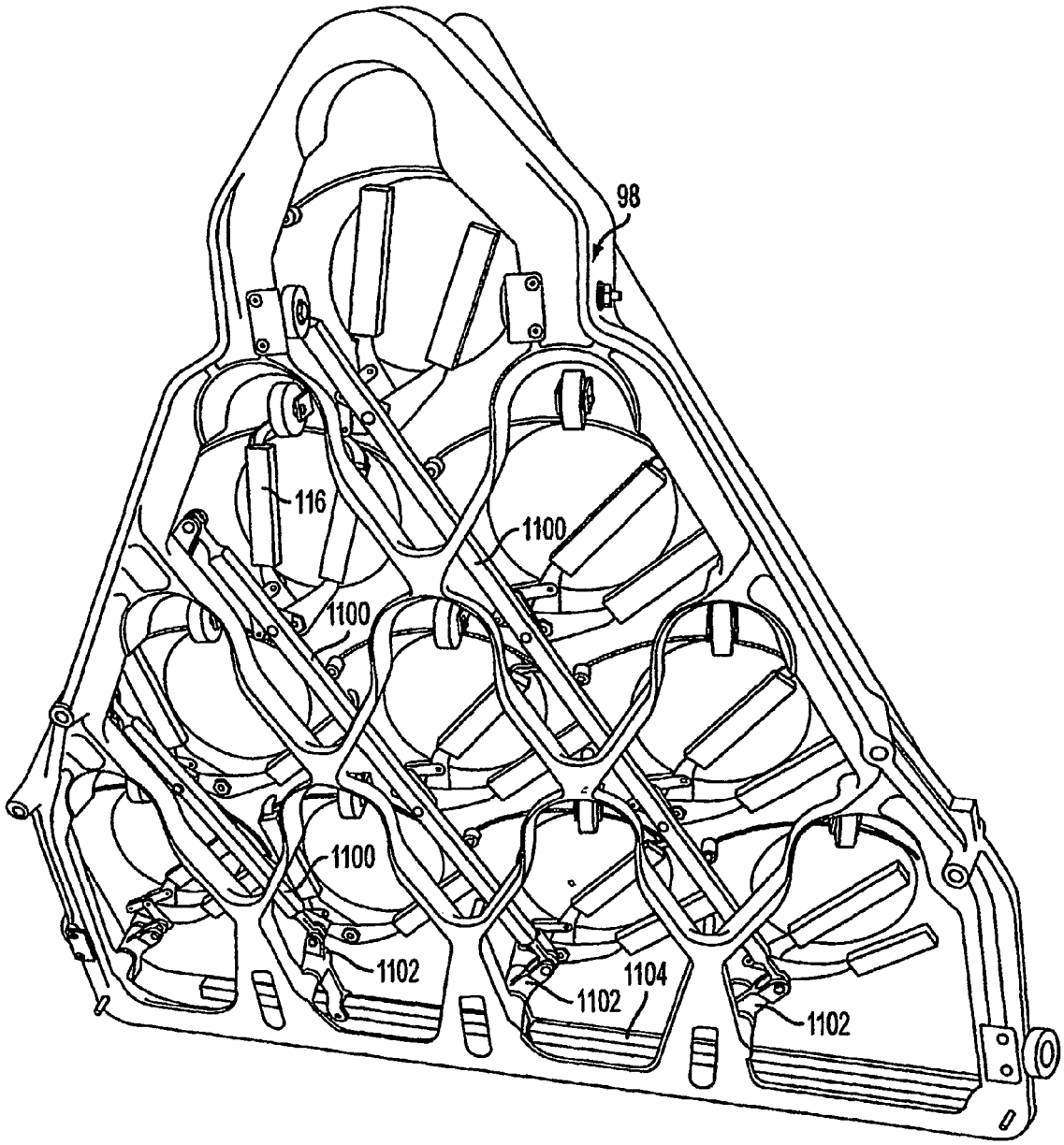
FIGS. 11A-B are views of the deck assembly.

FIG. 11A shows the underside of the movable deck 98 showing the series of mechanical devices in a BRUNSWICK automatic pin setter which clamp the standing pins. The series of mechanical devices include shift rods 1100 connected to the scissors 116. At the opposite end of the shift rods 1100, there are links 1102 which are connected to a crossbar 1104. In operation, the movement of the crossbar 1104 in the x direction shifts the position of the shift rods 1100 in the a direction to open the scissors 116. The movement of the crossbar 1104 in a direction opposite to the x direction closes the scissors 116.

Figure 11B:
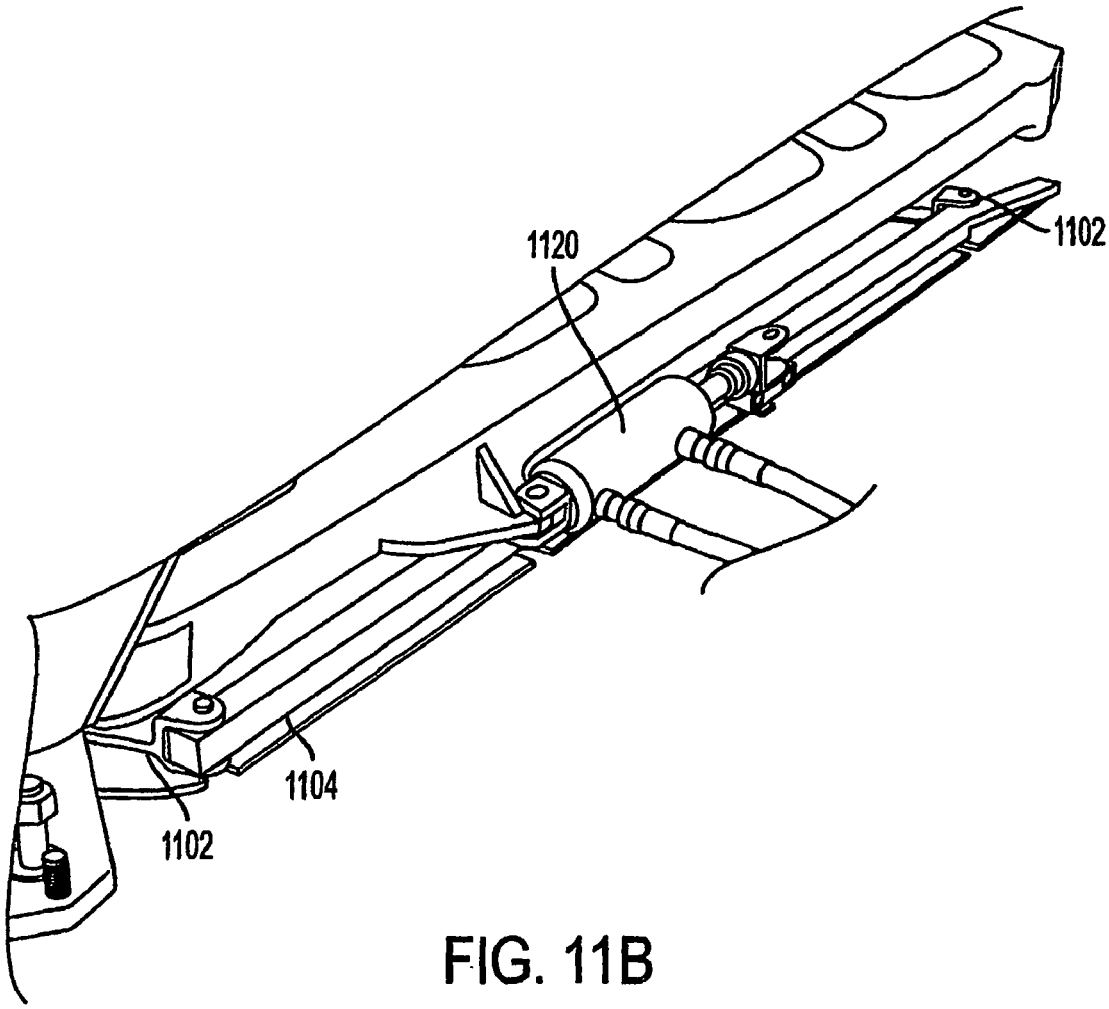

In the present invention as shown in FIG. 11B, the scissors 116 are not actuated by mechanical devices but are instead actuated by a single scissor drive cylinder 120 mounted transversely at the rear edge of the movable deck 98. A shaft 121 extending from the scissor drive cylinder 120 in a linear motion, is connected to the crossbar 1104 to open or close the scissors 116. The scissor drive cylinder 1120 again is controlled by the PLC 80 through an electrically controlled valve 82.

The deck operations thus are controlled by three hydraulic drive cylinders 94, 114, 120, each acting independently through electrical control valves 82 and controlled as to timing and operation by a single PLC 80. The basic function of the deck assembly 40 remains essentially the same but all of the mechanical drive components are replaced by the three simple hydraulic cylinders.

In addition to replacing the mechanical drive components of the deck mechanism, the present invention also uses a sensor to initiate the appropriate deck function. After a first ball is rolled, the system must first detect if there has been a strike or if standing pins remain, and if standing pins remain, whether any of the standing pins are "out of position." If there has been a strike, the computer 72 tells the rake 56 to lower and remove all pins. If there are standing pins remaining and they are in their proper position, the computer 72 actuates the scissors 116 to clamp the standing pins, lift the standing pins, and actuate the rake 56 to remove the dead wood. The standing pins are then replaced. If there are standing pins but one or more pins are nudged so that they are out of position and do not align with the scissors 116 and openings 110 in the deck assembly 40, the system has to be stopped so that the dead wood can be removed manually before the next ball is thrown. These functions in the conventional mechanical system are accomplished by mechanical devices that are actuated when the deck assembly 40 is lowered. If the deck assembly 40 lowers to its maximum extent, this indicates that all of the pins have been knocked down, and this triggers a rake 56 removal procedure. If there are standing pins that are in the right position, the deck assembly 40 lowers to a position higher than the lowest position, where it engages the standing pins, and stops. This actuates the scissors mechanism to pick the standing pins up. If there are standing pins that are out of position, the standing pins engage the bottom of the stationary deck 100 and do not extend into the opening in the stationary deck 100 and thus stop the stationary deck 100 at a higher position yet. This actuates a mechanical connection that stops the pin setter 10 for manual removal of the dead wood.

In the present invention, an electronic distance measuring device 99, such as an ultrasonic distance measuring device, is employed, as shown in FIG. 8. This is desirably mounted above the deck assembly 40 and is focused on the deck assembly 40 so that it detects the distance that the deck assembly 40 moves downwardly. The distance measuring device also can be mounted on the deck assembly 40 so it senses the distance between the bottom of the deck assembly 40 and the bowling lane 14. The device has a substantially continuous readout, and the PLC 80 is programmed so that if the readout remains the same for a predetermined delay, such as one second, this indicates that the deck assembly 40 has encountered a pin at that location, and this consequently triggers an appropriate pin setter action, depending on the deck elevation level detected and the first or second ball status. Other types of electronic distance measuring devices can be employed for this purpose without requiring a mechanical detection of deck position.

Figure 12:
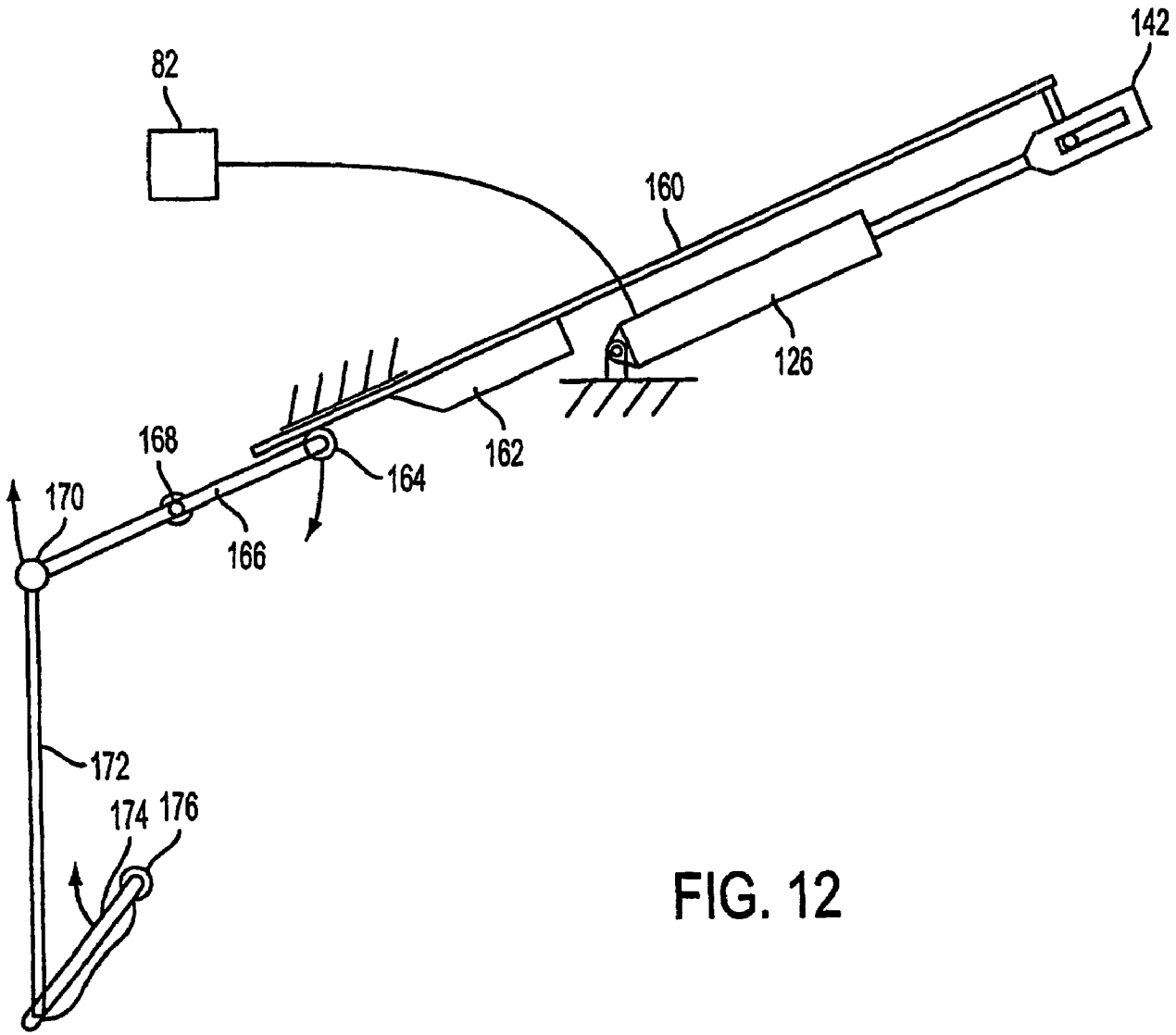
FIG. 12 is a view of the pit cushion lift mechanism.

FIGS. 12 and 13 show another aspect of the present invention. Here, the movement of the rake 56 is also controlled by a hydraulic device. The rake 56 is raised and lowered and reciprocated rearwardly and forwardly by a linear motion of an extendible output shaft of the rake drive cylinder 126. The rake drive cylinder 126 is in turn controlled by an electric valve 82 which is in turn controlled by the programming of the PLC 80.

The mechanical construction of the rake lift mechanism also has been improved in the present invention. In the prior system, a rake lift cam 63 rotated on an independent shaft actuates a cam follower 65 that is connected to a C-shaped lever 66 attached to the rake lift shaft 46. The C-shaped lever rotates 66 the rake lift shaft 46 and maintains the rake board 64 in a horizontal position as the rake support arms 58 are pivoted about the rake sweep shaft 48.

Figure 13A:
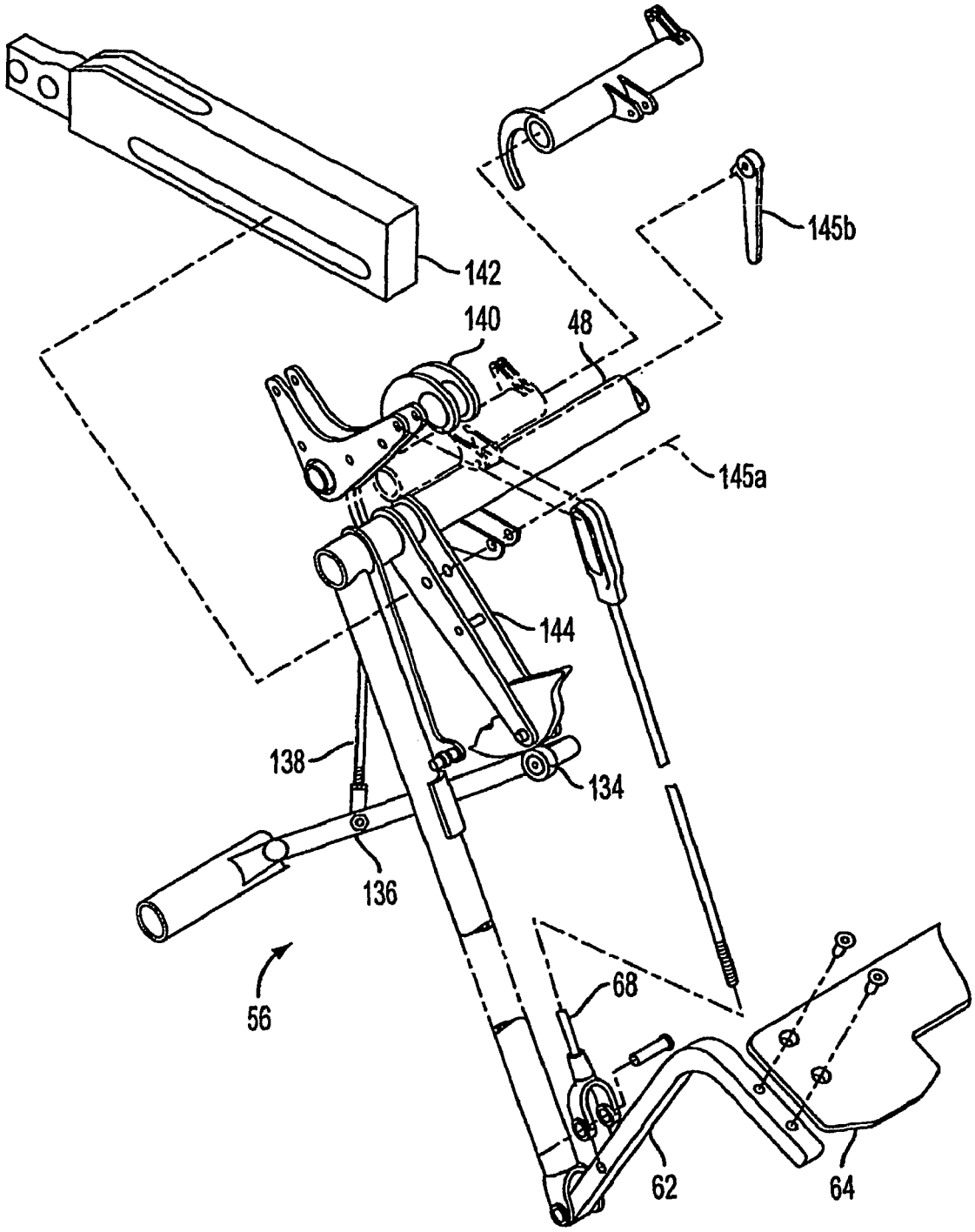
FIGS. 13A-C are views of the rake sweep assembly.
Figure 13B:
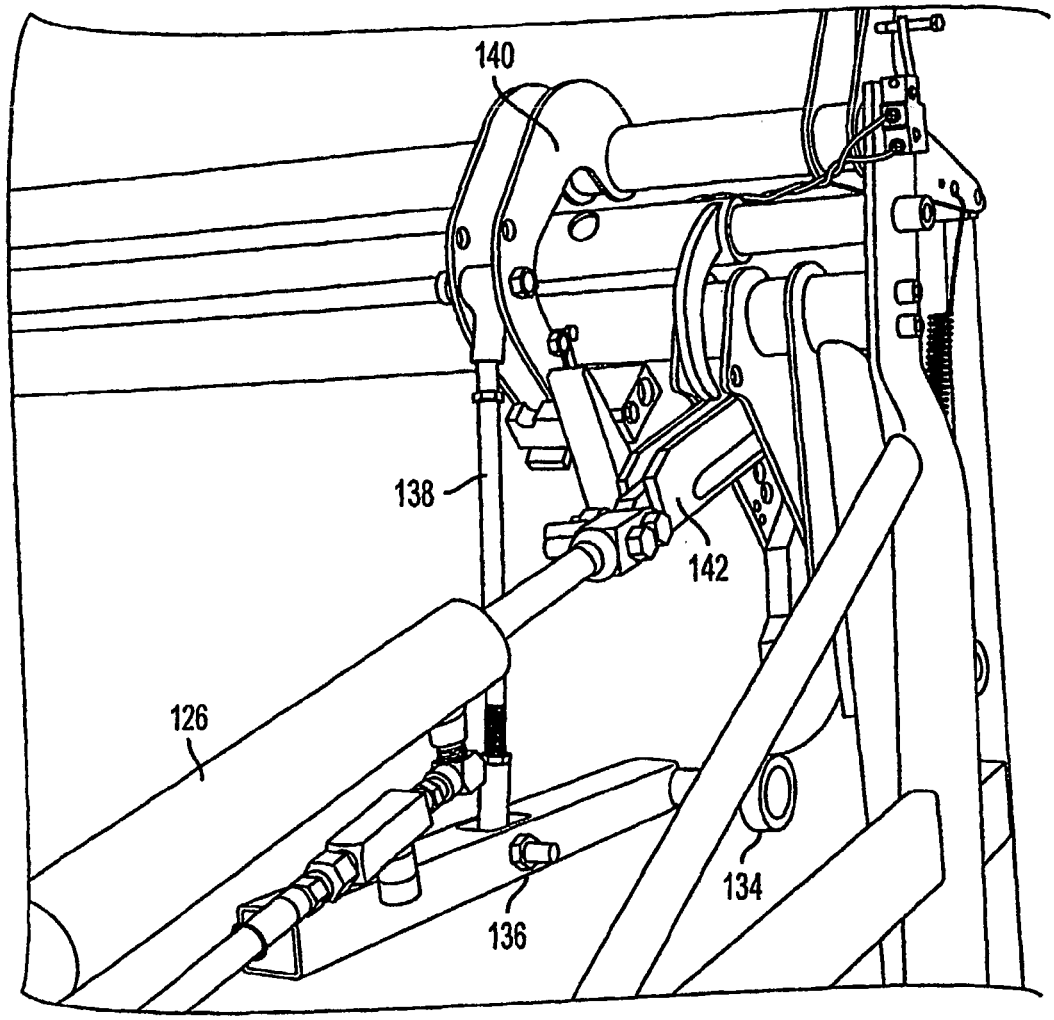
Figure 13C:
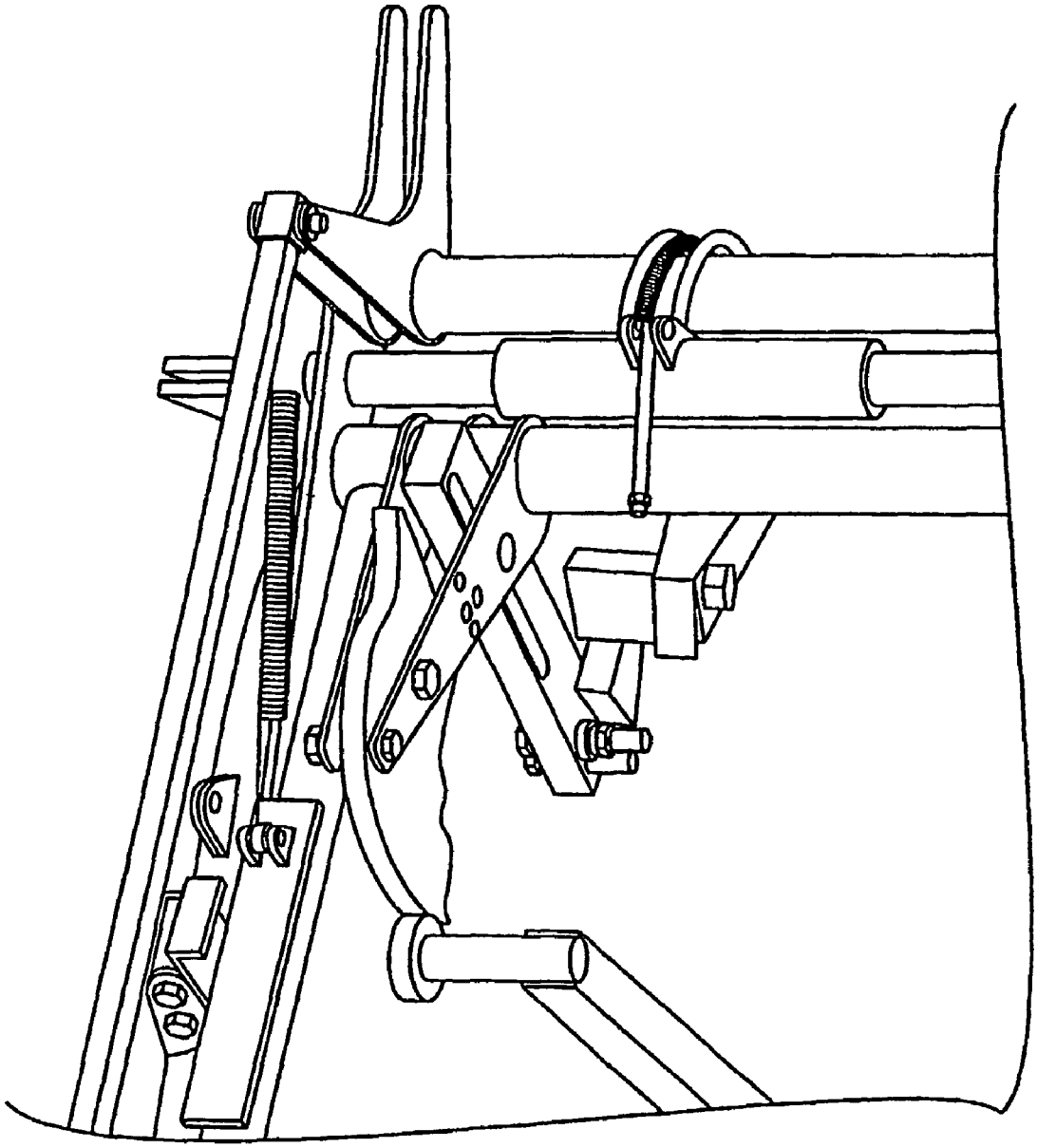
Figure 14:
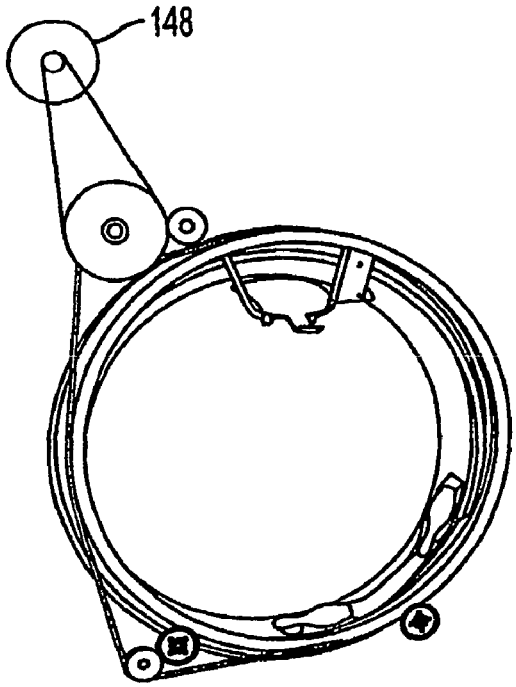
FIG. 14 is a view of the pin wheel elevator.

In the present invention, instead of mounting a cam on a separate shaft, which involves timing considerations, a cam 132 is mounted directly on the rake sweep shaft 48 through the rake arm 49, as shown in FIG. 13A-C. Cam 132 bears against a cam roller 134 on the end of cam follower 136, which is pivotally mounted to the frame on an opposite end thereof. FIG. 14 shows a drive link 138 extending from an intermediate portion of cam follower 136 into driving contact with C-shaped lever 140. Rake drive cylinder 126 includes an output shaft that is connected by a lost motion link 142 to a drive arm 144 mounted on rake sweep shaft 48. Cam 132 is bolted to the drive arm 144 comprising of two spaced plates.

The manner in which the rake sweep drive also lifts the pit cushion 174 is shown in FIG. 12. When the rake drive cylinder 126 is retracted, pit cushion drive rod 160 slides rearwardly in a linear path. A cam 162 having a beveled surface on the end thereof engages cam wheel 164 on pivot arm 166, which pivots about axis 168. An opposite end 170 of the pivot arm 166 engages an adjustable pit cushion linkage 172 that is connected to pit cushion 174, which is pivotally mounted at one end 176. Retraction of the rake drive cylinder 126 therefore causes a clockwise rotation of pivot arm 166, and this raises the pit cushion 174. The lifting of the pit cushion 174 can also be accomplished or enhanced by a spring mechanism.

In operation, the rake 56 is normally maintained in a raised position. After a ball has been rolled and an electronic signal generated thereby, the output shaft of the rake drive cylinder 126 is retracted. A first release is caused by plungers (FIG. 13C) which is rotated when a latch 139 that pivots on an axis 145*a* permits the rake board 64 and rake sweep arm 62 to pivot downwardly under the force of gravity to a position adjacent the surface of the bowling lane 14. Further retraction of the rake drive cylinder 126 causes lost motion link 142 to engage drive arm 144 on the rake sweep shaft 48 and rotate the rake sweep shaft 48, causing the rake 56 to retract rearwardly. As the rake 56 retracts rearwardly, cam roller 134 rides on cam 132. Cam 132 is shaped so that the rake board 64 is raised somewhat as the rake support arm 62 is retracted, causing the rake board 64 to be maintained in a horizontal position adjacent the surface of the bowling lane 14 as the rake 56 is retracted. With the cam 132 mounted directly on the rake sweep shaft 48 and controlling rake board position directly by the position of the rake support arm 58, no adjustment is necessary in order to insure that the rake board 64 is always properly positioned.

A fluid drive motor 146 also is substituted for a mechanical drive for operation of the turret 54, as shown in FIG. 8. Pins are delivered to the turret 54 by means of the cross conveyor 52, as in the conventional mechanical systems. However, in the conventional system, the turret movement is mechanically moved and released. In the present invention, the turret 54 is rotatably mounted for movement by means of a fluid drive motor 146. The fluid drive motor 146 exerts a constant rotational pressure on the turret 54. The mechanical sequencing and release mechanism of the prior system remains substantially the same. The insertion of each pin in the turret 54 releases a latch that permits the fluid drive motor 146 to move the next pin location into alignment with the cross conveyor outlet. When the turret 54 is full, the same mechanical system prevents the cross conveyor 52 from depositing additional pins on the turret 54.

The cross conveyor 52 can be is also independently driven by a fluid drive motor. In an alternative embodiment a fluid motor may drive the cross conveyor and the pin wheel elevator 24.

In another aspect of the present invention shown in FIG. 14, the pin wheel elevator 24 is driven by a fluid drive motor 148.

The present invention could employ a conventional ball wheel elevator driven by a fluid drive motor 146. However, an improved elevator system has been developed for the present invention.

Figure 16:
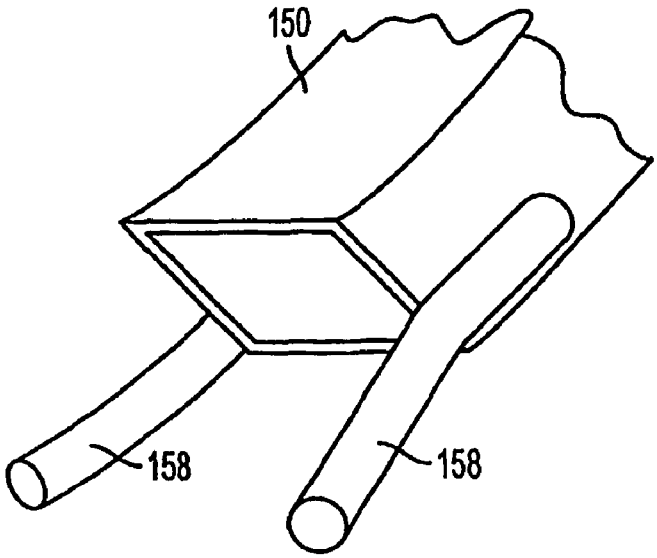
FIG. 16 is another view the ball elevator.

In the present invention, the ball elevator wheel 580 includes a pivoting arm 150 mounted for pivotal movement about an axis 152 concentric with the axis of the ball elevator wheel 580. The arm 150 engages a ball 182 as it reaches the ball elevator 30, and a hydraulic drive cylinder 154 pivots the arm 150 from a downwardly extending position to an upwardly extending position, where the ball 182 is lifted and deposited on the ball return track 184. The arm 150 is formed in an arcuate shape. FIG. 16 shows a pair of fingers 158 at the end of the pivoting arm 150 to engage the ball 182 between the fingers 158 and the end of the arm 150 and support the ball 182 until it is deposited at the entry of the ball return track 184. The simple movement of the arm 150 through an arc is sufficient to lift the ball 182 up to the ball return track 184. This eliminates the moving parts in the conventional rotating ball elevator wheel. The ball lifting device only needs to be actuated when a ball's presence is expected or detected in the pit 12. An electronic detector at the lift mechanism could be employed or a detector somewhat upstream of the lift mechanism would be satisfactory.

Figure 15:
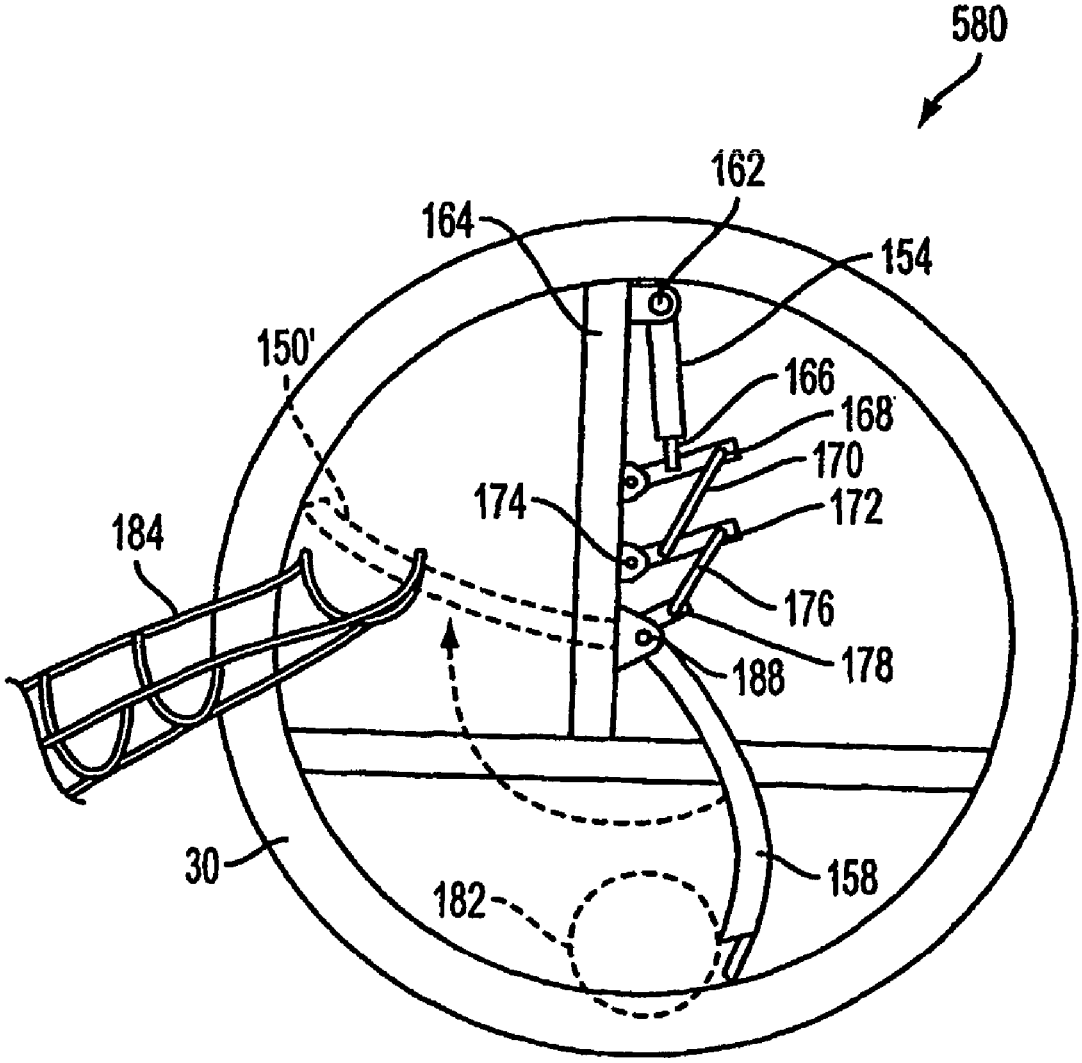
FIG. 15 is a view of a ball elevator.

As shown in FIG. 15, drive cylinder 154 is pivotally mounted to a fitting 162 at an upper end of vertical beam 164. An output shaft 166, which linearly extends out of the drive cylinder 154 in a linear motion, is connected to a link 168 that is pivotally mounted at one end to beam 164. An outer end of link 168 is connected to a link 170 that is connected to a midpoint of another link 172, which is in turn pivotally mounted at an inner end 174 to the vertical beam 164. Another link 176 is pivotally mounted to drive arm 178 that rotates an axle 180 on which pivoting arm 150 is mounted. This linkage mechanism interconnecting the drive cylinder 154 and the drive arm 150 increases the stroke of the drive cylinder 154 and makes it possible to rotate the axle 180 through a sufficiently large angle so that the pivoting arm 150 can pivot all the way up to position 150' (shown in phantom lines) where the bowling ball 182 is dumped on track 184.

Figure 17:
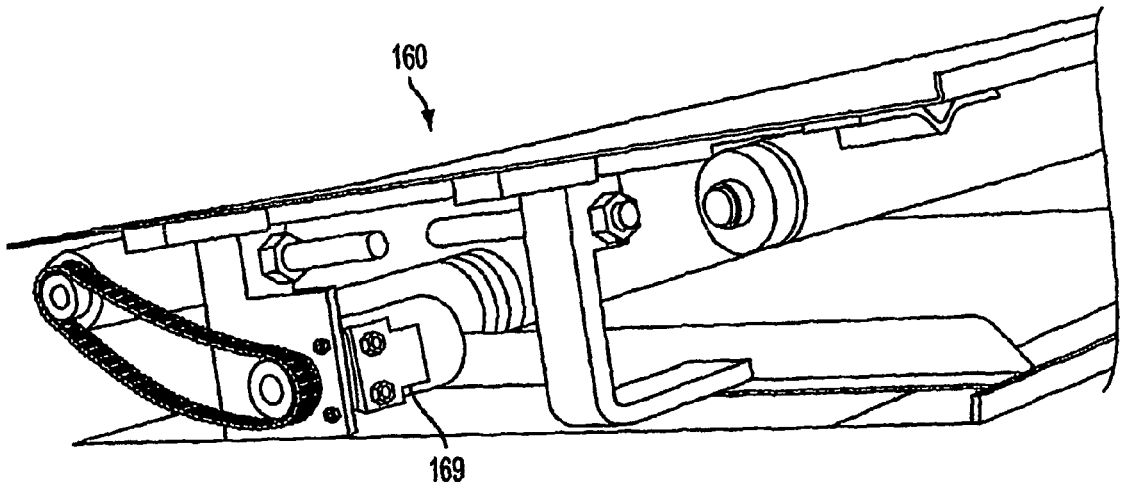
FIG. 17 is a view of the pit conveyor.

In the present invention, the pit conveyor 1700 shown in FIG. 17 also can be driven by a fluid drive motor 1720 in a continuously rotating fashion as a belt conveyor, rather than providing a vibrating conveyor as used in the prior devices.

All of these various hydraulic drive motors and drive cylinders can be controlled through electronic valves 82 by means of the programmable logic controller 80, and all of the settings and adjustments can be varied to fine tune and correct the timing and sequencing desired for any set of circumstances. All of this is achieved in a cost effective manner and provides a substantially trouble free system that does not require a specialized technician to repair.

Figure 18A:
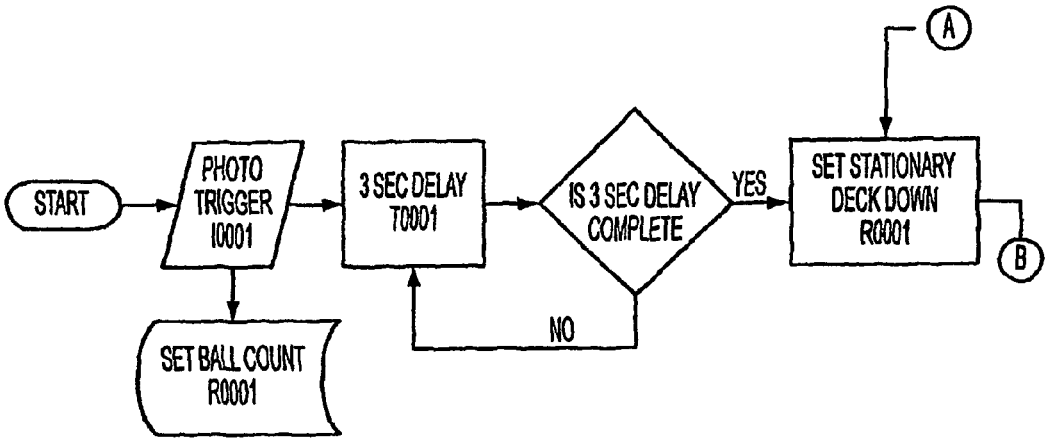
FIGS. 18A-C are flow diagrams showing the operation of the deck mechanism an operation of the present invention.
Figure 18B:
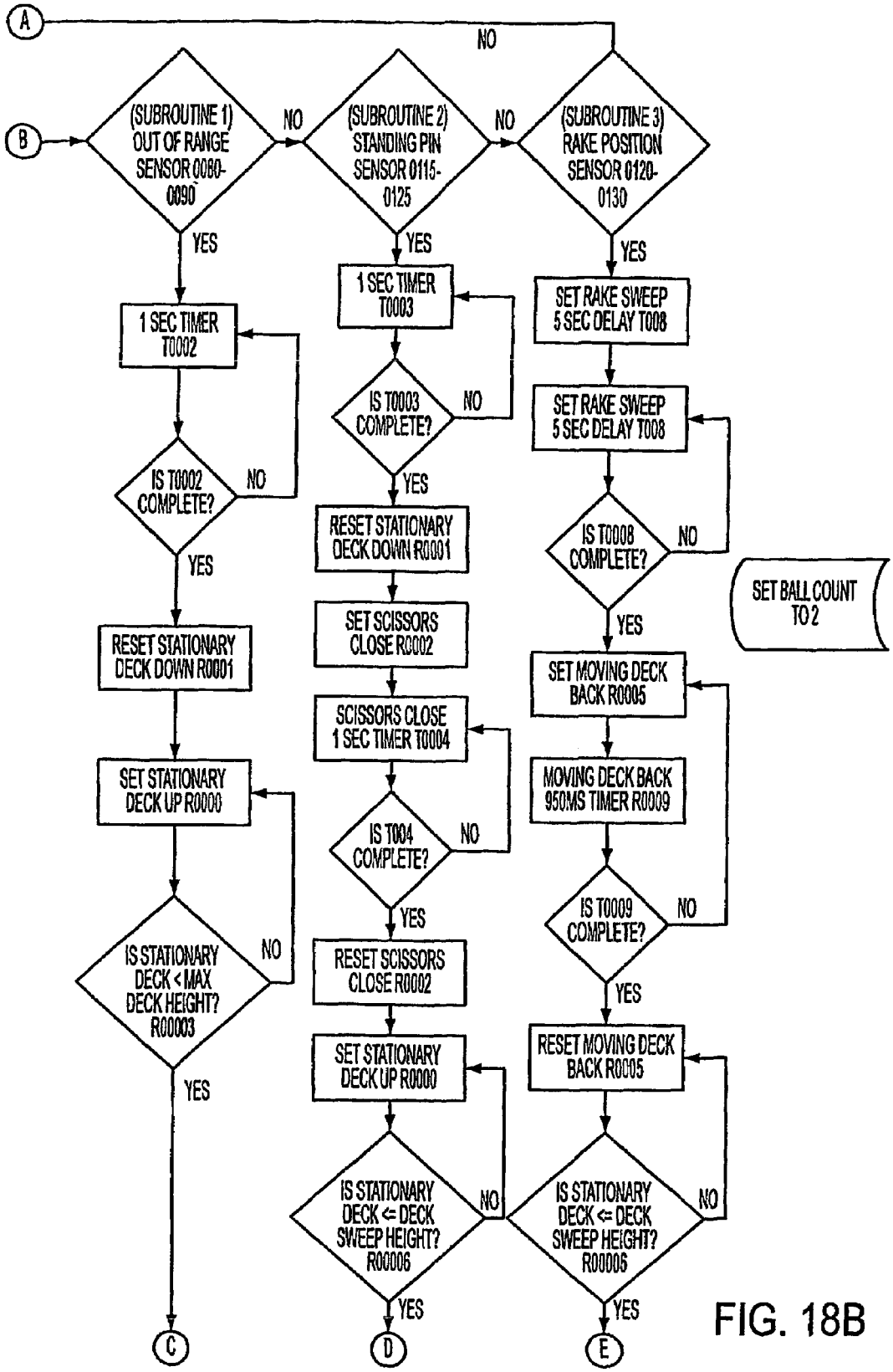
Figure 18C:
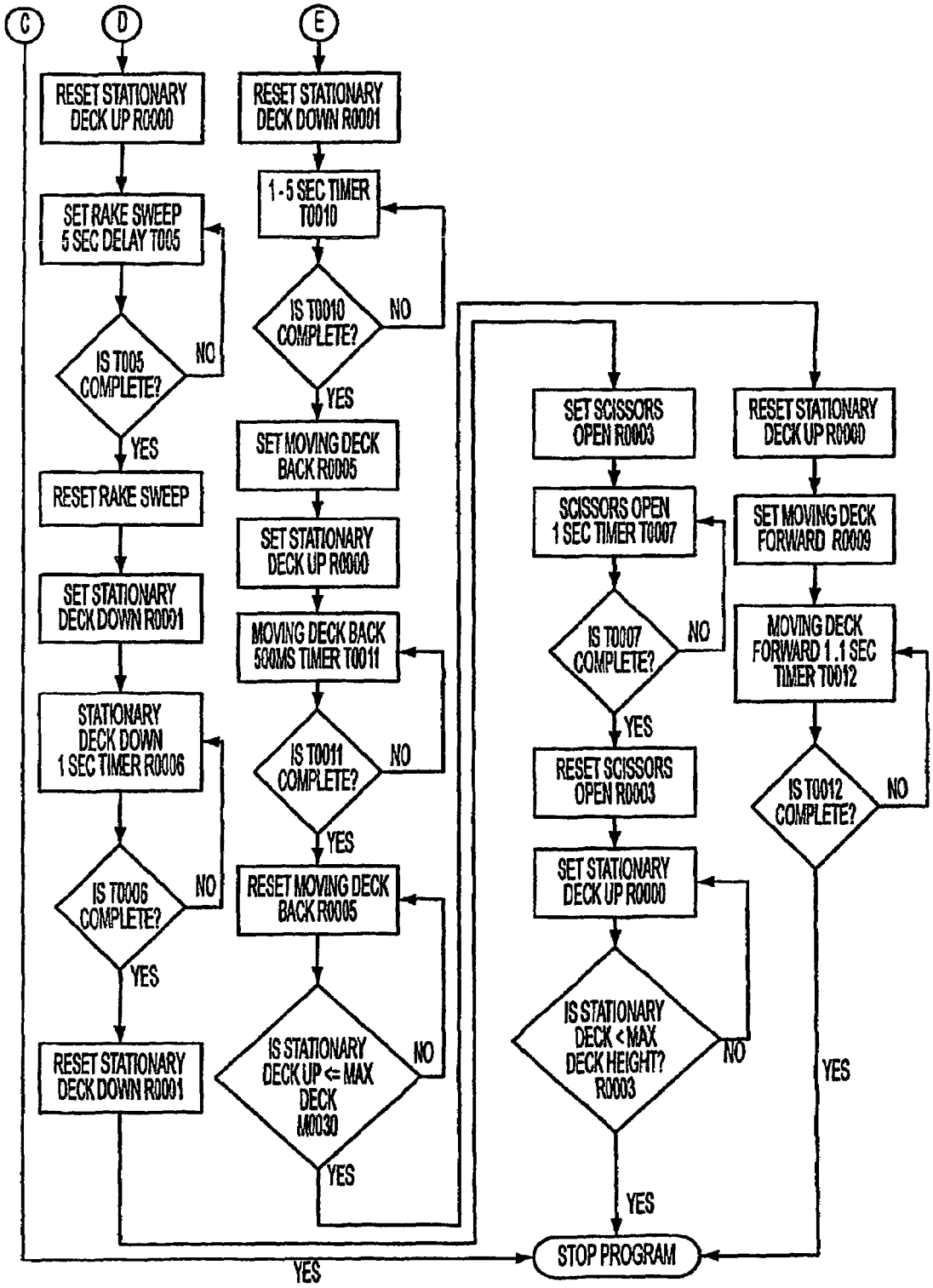

In operation, the present invention performs in a manner similar to prior pin setters, with the exception that the sequence and timing of the various functions is programmable. A flow chart setting forth the PLC program for deck operation is set for in FIGS. 18A-C and is described hereinbelow.

At the start, a ball is rolled. A photo trigger, such as a photo cell device or proximity device or the like, immediately upstream of the pin location indicates that a ball has been rolled, and a ball count is established (e.g., first ball). There is then a three second time delay in order to give any standing pins time to stop wobbling. The deck assembly 40 is then lowered. The distance that the deck assembly 40 lowers without encountering an obstacle determines what happens next. There are three possibilities.

If the deck assembly 40 encounters a standing, out of range pin, the deck assembly 40 is raised and the program is stopped until the fallen pins have been manually removed (if this is a first ball). If this is a second ball, the rake 56 is simply actuated to remove all remaining standing pins.

If, after a first ball, the deck assembly 40 is lowered to the position where at least one standing, in range pin is detected, at that point the scissors 116 are closed on the standing pins and the deck assembly 40 is raised. After a delay of five seconds, the rake sweep mechanism 700 is actuated to remove dead wood. The deck assembly 40 is then lowered and the scissors 116 are opened to re-spot the standing pins. After a second ball, all of the pins are swept from the bowling lane 14.

If, after a first ball, no standing pins are detected, the rake sweep mechanism 700 is actuated after a five second delay to remove all of the pins. Thereafter, the deck chutes 103 in the deck assembly 40 are filled by releasing the spoons in the buffer 54 with the movable deck 98 moved forwardly to in a position where the deck chutes 103 are aligned with rollers 108 on the stationary deck 100, so the pins rest on the rollers 108. The deck 40 is then lowered and the movable deck 98 is moved to the point where the pins are pulled off the tops of the rollers 108 and are positioned against the sides of the rollers 108, with the pins being held against the wheels by the fingers 112 on the movable deck 98. The belly of each pin is positioned above the roller 108 contact point, so that the pin cannot drop all the way down through the stationary deck 100.

When the deck 40 has been lowered to the proximity of the bowling lane 14, the movable deck 98 then moves all the way back so as to release the pins onto the pin setter location 12 on the bowling lane 14. The deck 40 is thereafter raised until a ball has been rolled.

The foregoing operation of resetting the pins occurs after any ball in which no standing pins are detected and automatically after a second ball. This operation can also be triggered if, for any reason, the operator wishes to cycle the pin setter and start over. This might occur if a foul were detected (e.g., the bowler steps over the foul line) and the bowler's turn is nullified, requiring a new set of pins.

The foregoing aspects and other aspects can be programmed into the PLC 80, with appropriate delays generated by the computer 72 and not requiring timed mechanical sequencing. The number and position of standing pins need not be detected by the position at which the deck 40 encounters an obstacle in its vertical path. Electronic position detectors, digital photographic sensors and imaging detecting software, and other known techniques can be used to ascertain the status of the standing pins after any ball is rolled.

The other elements in the system also are programmed to deliver fallen pins from the pit to the turret 54 and to return bowling balls to the head of the bowling lane 14. Continuous operation of the ball elevator 22 is not required but can be triggered when the presence of a ball is detected. The pin elevator 24 can be operated continuously if pins are continuously being transferred from the pit 18 to the turret area, but the system can be programmed to deactuate the fluid drive motor 148 of the pin elevator 24 at any time, if desired.

In one alternative embodiment, the programmable logic controller 80 may control the operations of one pin setter of the present invention for one bowling lane. Alternatively, the programmable logic controller 80 may control a plurality of the pin setters of the present invention for a plurality of bowling lanes.

Another embodiment of the present invention includes methods for operating an electromechanical pin setter as described above.

The present invention can also be embodied as computer readable codes on a computer readable recording medium. The computer readable recording medium is any data storage device that can store data which can be thereafter read by a computer system. The programs, codes, and code segments for accomplishing the present invention can be easily construed by programmers skilled in the art to which the present invention pertains.

It should be understood that the foregoing is merely exemplary of the exemplary practice of the present invention and that various changes in the arrangements and details of construction may be made in the embodiments disclosed herein without departing from the spirit and scope of the present invention.

What is claimed is:

1. An electromechanical pin setter wherein a deck assembly holds pins in deck chutes and reciprocates vertically to spot and re-spot pins on a pin setting location on a bowling lane, a rake mechanism removes pins from the bowling lane, a pit conveyor moves pins and a bowling ball toward a pin elevator, the pin elevator in a pit area lifts pins to a cross conveyor, the cross conveyor delivers pins to a turret, the turret distributes pins to the deck chutes, a ball elevator to lift the bowling ball to a ball return track, the electromechanical pin setter comprising:

a hydraulic drive component comprising a fluid drive cylinder, hydraulic drive component operated by a source of pressurized fluid through an electrically controlled valve, to control an operation of at least one of the deck assembly, the rake mechanism, and the ball elevator, through a linear motion of the fluid drive cylinder; and a controller individually controlling and sequencing operations of the electrically controlled valve to control operations of the hydraulic drive component wherein said ball elevator comprises:

a plurality of linkages connected in series;

a ball lift arm disposed at one end of a first one of said plurality of linkages;

said hydraulic drive component comprises the drive cylinder including a base and an extendable shaft, wherein said base is attached to said frame and the extendable shaft is attached to a first end of a second one of said plurality of linkages;

wherein a second end of said second one of said plurality of linkages is attached to a midpoint of a third one of said plurality of linkages;

wherein a first end of said third one of said plurality of linkages is attached to the first one of said plurality of linkages, on which the ball lift arm is disposed; and wherein an extension of said extendable shaft causes said ball lift arm to rotate about an axle and move a bowling ball through an arc motion to a guide track.

2. The electromechanical pin setter of claim 1 further comprising a frame and a deck lift assembly, wherein the deck lift assembly comprises:

a deck lift shaft rotatably disposed in said frame;

deck lift arms extending from said deck lift shaft;

deck support arms attached said deck lift arms and said deck assembly;

a drive arm attached to said shaft; and said hydraulic drive component comprises the drive cylinder including a base and an extendable shaft, wherein said base is directly attached to said frame and said extendable shaft is directly attached to said drive arm and an extension of said extendable shaft against said drive arm rotates said deck lift shaft, pivots deck lift arms, lowers deck supports arms, to lower said deck assembly, the base and the extendable shaft are aligned along an axis, and the extension of said extendable shaft is the linear motion and the drive arm rotates directly as a result of only the linear motion.

3. The electromechanical pin setter of claim 1, wherein the deck assembly comprises:

a movable deck;

an upper deck disposed below said movable deck;

a lower deck disposed below said upper deck;

said hydraulic drive component comprises the drive cylinder including a base and an extendable shaft, wherein said base is attached to said upper deck and said extendable shaft is attached to said movable deck, wherein the movement of said extendable shaft moves the movable deck with respect to said upper deck, the base and the extendable shaft are aligned along an axis, and the movement of said extendable shaft is the linear motion and the movable deck directly as a result of only the linear motion.

4. The electromechanical pin setter of claim 1, wherein the deck assembly comprises:

a movable deck;

an upper deck disposed below said movable deck;

a lower deck disposed below said upper deck;

a plurality of pin holes disposed at said lower deck;

a plurality of scissors each disposed at a corresponding pin hole;

a scissor drive mechanism operable to open and close said plurality of scissors; and said hydraulic drive component comprises the drive cylinder including a base and an extendable shaft, wherein said base is attached to said lower deck and said extendable shaft is attached to a crossbar of said scissor drive mechanism to open and close said plurality of scissors, the base and the extendable shaft are aligned along an axis, and an extension of said extendable shaft is the linear motion and the crossbar moves directly as a result of only the linear motion.

5. The electromechanical pin setter of claim 1 further comprising a rake sweep mechanism wherein said hydraulic drive component comprises the drive cylinder including a base and an extendable shaft and the hydraulic drive component is operable to actuate the rake sweep mechanism to move bowling pins disposed on a bowling lane.

6. The electromechanical pin setter of claim 1, wherein the pit conveyor comprises a bell driven a fluid drive motor continuously rotating said belt.

7. The electromechanical pin setter of claim 1, wherein a fluid drive motor drives at least one of the pin elevator and a cross conveyor.

8. The electromechanical pin setter of claim 1, wherein said turret is driven by a fluid drive motor.

9. A method for operating an electromechanical pin setter wherein a deck assembly holds pins in deck chutes and reciprocates vertically to spot and re-spot pins on a pin setting location on a bowling lane, a rake mechanism removes pins from the bowling lane, a pit conveyor moves pins and a bowling ball toward a pin elevator, the pin elevator in a pit area lifts pins to a cross conveyor, the cross conveyor delivers pins to a turret, the turret distributes pins to the deck chutes, a ball elevator to lift the bowling ball to a ball return track, the method comprising:

controlling an operation of at least one of the deck assembly, the rake mechanism, and the ball elevator by a hydraulic drive component including a fluid drive cylinder, through a linear motion of the fluid drive cylinder, said fluid drive cylinder operated by a source of pressurized fluid through an electrically controlled valve; and individually controlling and sequencing operations of the electrically controlled valve to control operations of the hydraulic drive component through a programmable controller, wherein said controlling comprises controlling the operation of the ball elevator, the ball elevator including a plurality of linkages connected in series, a ball lift arm disposed at one end of a first one of said plurality of linkages, said hydraulic drive component includes the drive cylinder including a base and an extendable shaft, wherein said base is attached to said frame and the extendable shaft is attached to a first end of a second one of said plurality of linkages, wherein a second end of said second one of said plurality of linkages is attached to a midpoint of a third one of said plurality of linkages;

wherein a first end of said third one of said plurality of linkages is attached to the first one of said plurality of linkages, on which the ball lift arm is disposed; and wherein an extension of said extendable shaft causes said ball lift arm to rotate about an axle and move a bowling ball through an arc motion to a guide track.

10. The method according to claim 9 further comprising raising, lowering and horizontally reciprocating the rake sweep mechanism by one or more hydraulic cylinders of the hydraulic drive component, and maintaining a rake of the rake sweep mechanism in about a horizontal position by a cam device operated directly off a rotating rake sweep shaft that reciprocates the rake back and forth.

11. The method according to claim 10 further comprising lifting a bowling ball from a pickup location to an entrance of a return track at an elevated position by means of a pivoting arm that engages the ball at a lower position and causes the ball to follow a path until the ball reaches an entry of the ball return track, at which position the ball rolls into the entrance of the ball return track, the pivoting arm thereafter returning to a lowered position for picking up a next bowling ball.

12. The method according to claim 11, wherein the pivoting arm has spaced support elements on a ball contacting end thereof, wherein the support elements engage the ball at spaced locations thereon so as to cause the ball to follow the path of the ball elevator wheel from the pickup position to the return position.

13. The method according to claim 9, wherein the operation of controlling comprises raising and lowing the deck assembly through the linear motion of the fluid drive cylinder.

14. The method according to claim 9, wherein the operation of controlling comprises moving a movable deck of the deck assembly through the linear motion, with respect to an upper deck of the deck assembly to position pin chutes of upper deck substantially over corresponding pin holes of said upper deck, and the fluid drive cylinder is connected to the movable deck and the upper deck.

15. The method according to claim 9, wherein the operation of controlling comprises opening and closing scissors of the deck assembly, and the fluid drive cylinder is connected to a crossbar of a lower deck of the deck assembly and a plurality of linkages connected to the scissors.

16. The method according to claim 9, wherein the operation of controlling comprises driving a belt of the pit conveyor with a fluid drive motor.

17. The method according to claim 9, wherein the operation of controlling comprises driving at least one of the pin elevator and the cross conveyor using one fluid drive motor connected to the at least one of the pin elevator and the cross conveyor.

18. The method according to claim 9, wherein the operation of controlling comprises driving the turret using a fluid drive motor connected to the turret.

19. A computer-readable recording medium for recording a computer program code for enabling a computer to provide a service of controlling an electromechanical pin setter wherein a deck assembly holds pins in deck chutes and reciprocates vertically to spot and re-spot pins on a pin setting location on a bowling lane, a rake mechanism removes pins from the bowling lane, a pit conveyor moves pins and a bowling ball toward a pin elevator, the pin elevator in a pit area lifts pins to a cross conveyor, the cross conveyor delivers pins to a turret, the turret distributes pins to the deck chutes, a ball elevator to lift the bowling ball to a ball return track, the service comprising:

controlling an operation of at least one of the deck assembly, the rake mechanism, and the ball elevator by a hydraulic drive component including a fluid drive cylinder, through a linear motion, said fluid drive cylinder operated by a source of pressurized fluid through an electrically controlled valve; and individually controlling and sequencing operations of the electrically controlled valve to control operations of the hydraulic drive component through a programmable controller, wherein said controlling comprises controlling the operation of the ball elevator, the ball elevator including a plurality of linkages connected in series, a ball lift arm disposed at one end of a first one of said plurality of linkages, said hydraulic drive component includes the drive cylinder including a base and an extendable shaft, wherein said base is attached to said frame and the extendable shaft is attached to a first end of a second one of said plurality of linkages, wherein a second end of said second one of said plurality of linkages is attached to a midpoint of a third one of said plurality of linkages;

wherein a first end of said third one of said plurality of linkages is attached to the first one of said plurality of linkages, on which the ball lift arm is disposed; and wherein an extension of said extendable shaft causes said ball lift arm to rotate about an axle and move a bowling ball through an arc motion to a guide track.

* * * * *